US008273144B2

(12) United States Patent
Shore et al.

(10) Patent No.: US 8,273,144 B2
(45) Date of Patent: Sep. 25, 2012

(54) AIR TREATMENT DEVICE AND HOUSING FOR AN AIR TREATMENT DEVICE

(75) Inventors: Angela Nixon Shore, State Road, NC (US); Annie Pierce Haynes, Troutman, NC (US); Carolyn Morgan Stafford, Cornelius, NC (US); Jay Kinsley Fording, Huntersville, NC (US); Paul Richard Manley, Huntersville, NC (US); Michael Anthony Lorenz, Gahanna, OH (US); Ludwin Miguel Mora, Worthington, OH (US); Hun Jung Choi, Kyounggido Koyangsi (KR); Young Jo Kim, Seoul (KR)

(73) Assignee: Lowe's Companies, Inc., Mooresville, NC (US)

( * ) Notice: Subject to any disclaimer, the term of this patent is extended or adjusted under 35 U.S.C. 154(b) by 264 days.

(21) Appl. No.: 12/577,564

(22) Filed: Oct. 12, 2009

(65) Prior Publication Data

US 2011/0083757 A1 Apr. 14, 2011

(51) Int. Cl.
*B01D 50/00* (2006.01)

(52) U.S. Cl. ..... 55/467; 55/471; 55/482; 55/490; 96/417

(58) Field of Classification Search ..... 55/467, 55/471, 472, 482, 490; 96/417
See application file for complete search history.

(56) References Cited

U.S. PATENT DOCUMENTS

| | | | | |
|---|---|---|---|---|
| D360,028 | S | 7/1995 | Matsuda | |
| 6,004,367 | A | 12/1999 | Stopyra et al. | |
| 6,328,791 | B1 | 12/2001 | Pillion et al. | |
| 6,391,102 | B1 | 5/2002 | Bodden et al. | |
| 6,447,587 | B1 | 9/2002 | Pillion et al. | |
| 6,494,940 | B1 | 12/2002 | Hak | |
| 6,497,840 | B1 | 12/2002 | Palestro et al. | |
| 6,610,118 | B2 | 8/2003 | Bryce et al. | |
| 6,616,722 | B1 | 9/2003 | Cartellone | |
| 6,645,277 | B1 | 11/2003 | Franz et al. | |
| 6,660,070 | B2 | 12/2003 | Chung et al. | |
| 6,712,889 | B2 | 3/2004 | Pillion et al. | |
| D497,984 | S | 11/2004 | Tokunaga | |
| 6,869,468 | B2 | 3/2005 | Gibson | |
| 6,919,809 | B2 | 7/2005 | Blunn et al. | |
| 6,984,259 | B2 | 1/2006 | Hurst | |
| 7,132,003 | B2 | 11/2006 | Hirayama et al. | |
| 7,241,326 | B2 | 7/2007 | Han et al. | |
| 7,258,728 | B2 | 8/2007 | Lim et al. | |
| 7,537,649 | B2 | 5/2009 | Pippel et al. | |
| 7,632,340 | B2 * | 12/2009 | Brady et al. | 96/26 |
| 2005/0031448 | A1 | 2/2005 | Lasko et al. | |
| 2006/0199515 | A1 | 9/2006 | Lasko et al. | |
| 2007/0004328 | A1 | 1/2007 | Balzer | |
| 2007/0209701 | A1 | 9/2007 | Lasko et al. | |

(Continued)

*Primary Examiner* — Robert A Hopkins
(74) *Attorney, Agent, or Firm* — Moore & Van Allen, PLLC; W. Kevin Ransom

(57) ABSTRACT

Various embodiments of air treatment devices (and housings therefor) are provided. The housings are generally configured to provide air treatment devices that lessen the perceived size of the air treatment devices. Further, embodiments provide housings that are typically easier to clean and maintain and to provide ease in access to internal components of the air treatment devices. Embodiments may also position a control display associated with an air treatment device, such that the control display is visible from a position in front and above the air treatment device. Embodiments may also be configured to minimize and/or inhibit air exiting from the air outlet of the air treatment device from immediately reentering the air inlet and thus being recirculated.

44 Claims, 22 Drawing Sheets

U.S. PATENT DOCUMENTS

2007/0221061 A1 9/2007 Steiner
2008/0134899 A1 6/2008 Subbarao et al.
2008/0188173 A1 8/2008 Chen et al.
2008/0216657 A1 9/2008 Brady et al.

* cited by examiner

AIR TREATMENT DEVICE AND HOUSING FOR AN AIR TREATMENT DEVICE

FIELD

In general, embodiments of the present invention relate to air treatment devices, such as fans, air purifiers, humidifiers, dehumidifiers, air conditioning units, etc. and more particularly, to housings for air treatment devices.

BACKGROUND

Air treatment devices, such as fans, air purifiers, humidifiers, de-humidifiers, air conditioning units, etc., typically comprise at least an inlet and an outlet and some form of air treatment such as a fan. Air treatment devices of various shapes and sizes are known. However, many, if not all, current air treatment devices have designs that do not adequately address current issues associated with their use and operation.

For example, many air treatment devices employ intake louvers for receiving air into the devices. These louvers collect dust particles located in the air and require frequent cleaning Louvered structures, however, are generally difficult to clean. Spacing between louvers is typically narrow making cleaning dust from the louvers difficult.

Another issue noted with many conventional air treatment devices is that they do not adequately prevent air that exits the air outlet from immediately reentering the air treatment device through the air inlet. Recirculation of treated air into the device decreases the unit's capacity to receive untreated air.

An additional issue with many conventional air treatment devices is that their internal components are not easily accessible and are difficult to maintain and clean. One further issue is that many prior art air treatment devices are not aesthetically pleasing and appear bulky, obtrusive, or excessively imposing.

BRIEF SUMMARY OF EMBODIMENTS OF THE PRESENT INVENTION

In general terms, embodiments of the present invention relate to air treatment devices, such as fans, air purifiers, humidifiers, de-humidifiers, air conditioning units, etc., comprising specifically-shaped housings for performing particular functions. For example, in one embodiment, a housing for an air treatment device is provided comprising a front portion and a rear portion. An air inlet is located on the front portion, and an air outlet is positioned on the rear portion. The rear portion comprises first and second opposed side surfaces respectively extending rearward from the front portion. The first side surface comprises a first curvature adjacent the front portion that is concave to thereby direct air flow from the air outlet away from the air inlet. In some embodiments, the first side surface of the rear portion comprises a second curvature adjacent the first curvature, wherein the second curvature is convex. In a further embodiment, the air outlet is located on the second curvature of the first side surface.

In one embodiment, a housing for an air treatment device comprises front and rear portions. The rear portion comprises first and second opposed side surfaces respectively extending rearward from the front portion. An air inlet is located on the front portion, and an air outlet is located on the rear portion. The first and second side surfaces of the rear portion of this embodiment comprise respective concave curves adjacent to the front portion and convex curves respectively adjacent the concave curves. In some embodiments, the convex curves of the first and second side surfaces of the rear portion are adjacent to each other such that the first and second sides of the rear portion form a generally bell-shaped curve.

In some embodiments, the first and second sides converge around a top of the rear portion, while maintaining the convex and concave combination of curves that define the bell-shaped curvature, to define a similarly curved top of the rear portion that flares upwardly and laterally outwardly as the top of the rear portion approaches the front portion. Further, in some embodiments, the bell-shaped curvature is positioned between an air outlet on the rear portion of the housing and an air inlet on the front portion of the housing, such that the shape and position of the bell-shaped curvature directs air flowing out of the air outlet away from the air inlet.

In another embodiment, a housing for an air treatment device has a curvature that extends from a first point positioned on an upper region of the front portion of the housing and continues upwardly and rearward to a second point positioned near a top perimeter of the front portion of the housing. The shape and location of the curvature makes the air treatment device aesthetically pleasing and appear slimmer from front to back than it would appear without the curvature. In other embodiments, the curvature also makes the air treatment device appear slim from side to side because the curvature diverges rearward as the front portion extends laterally away from a central region (or a plane of symmetry) of the housing. In some embodiments, the curvature is convex and diverges rearward as the front portion extends upwardly away from a bottom portion of the air treatment device. Additionally, in some embodiments, the curvature also includes at least a portion of a control display for use in operating at least one aspect of the air treatment device. The control display may be provided with an outer surface curvature that generally conforms to the curvature of the housing such that the display is visible from both a frontward and upward direction.

In still another embodiment, an air treatment device includes a cowling releasably connected to the housing of the air treatment device. In some embodiments, the cowling is easily removable, thereby making itself and any internal components of the air treatment device easy to access, maintain, and/or clean. Also in some embodiments, the cowling is positioned relative to a recessed portion in the front portion of the housing, such that together the cowling and edges of the recessed portion define a generally U-shaped opening to an air inlet for air to enter the air treatment device. For example, in one embodiment, the cowling abuts one of the edges of the recessed portion and is spaced apart from the other edges to thereby define a generally U-shaped opening to an air inlet for air to enter the air treatment device. In many embodiments, the cowling also comprises a curvature that may conform to one or more curvatures in the housing, such that the cowling smoothly transitions into the housing and helps the air treatment device appear sleek from front to back and/or from side to side.

In another embodiment, an air treatment device includes a power cord management system for storing a power cord associated with the air treatment device. In some embodiments, the power cord management system includes a slot extending into or through a portion of the housing in which the power cord may be at least partially inserted and/or stored. In another embodiment, the power cord management system includes a recessed portion and one or more knobs positioned in the recessed portion, such that a power cord associated with the device may be wrapped around the one or more knobs and stored at least partially within the recessed portion.

A housing for a portable air treatment device is also provided with a cavity in the housing for storage of a remote control. In one embodiment, the cavity is located on a rear portion of the housing so as to hide it from view.

BRIEF DESCRIPTION OF THE FIGURES

Figure 1A:
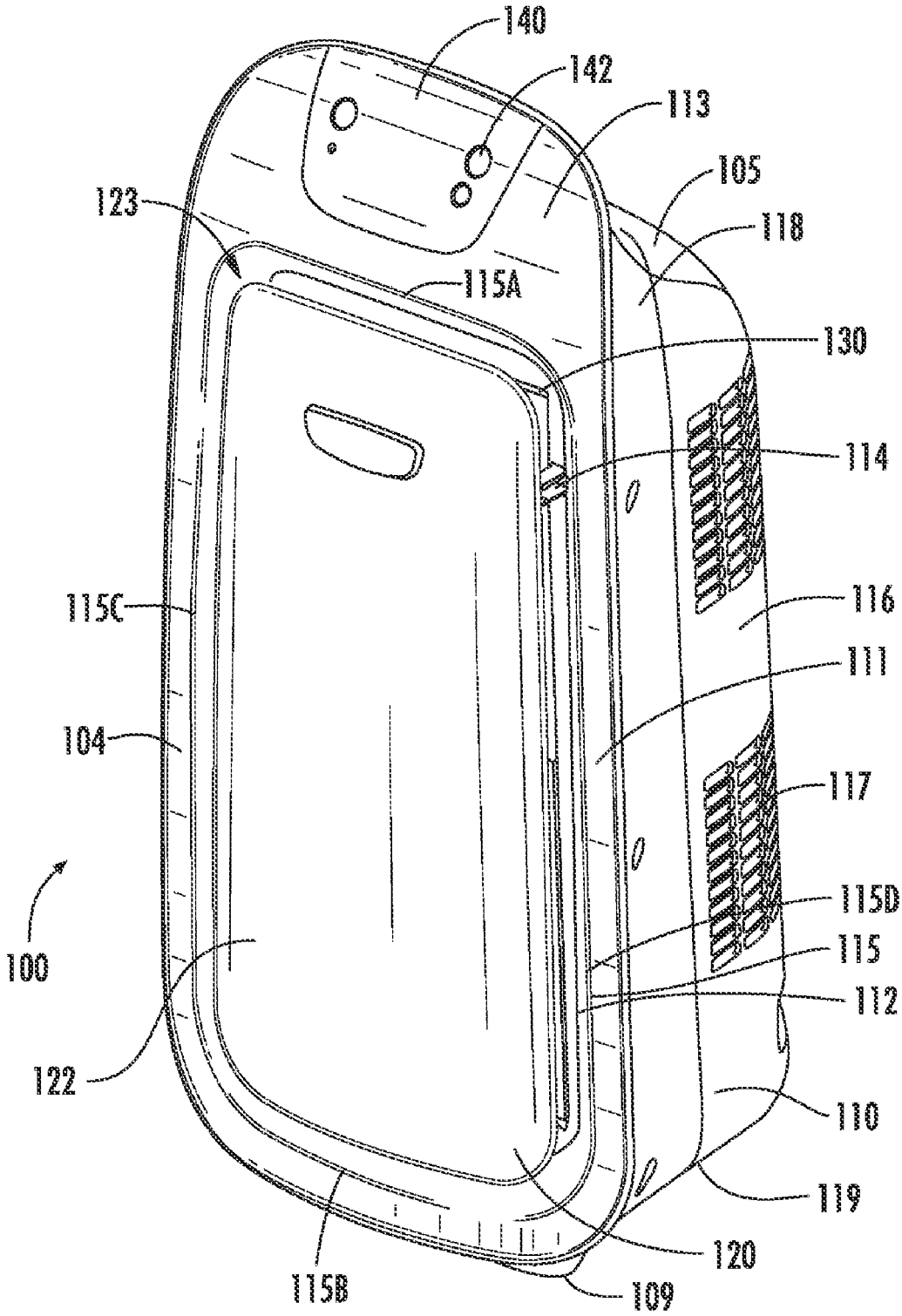
Figure 1B:
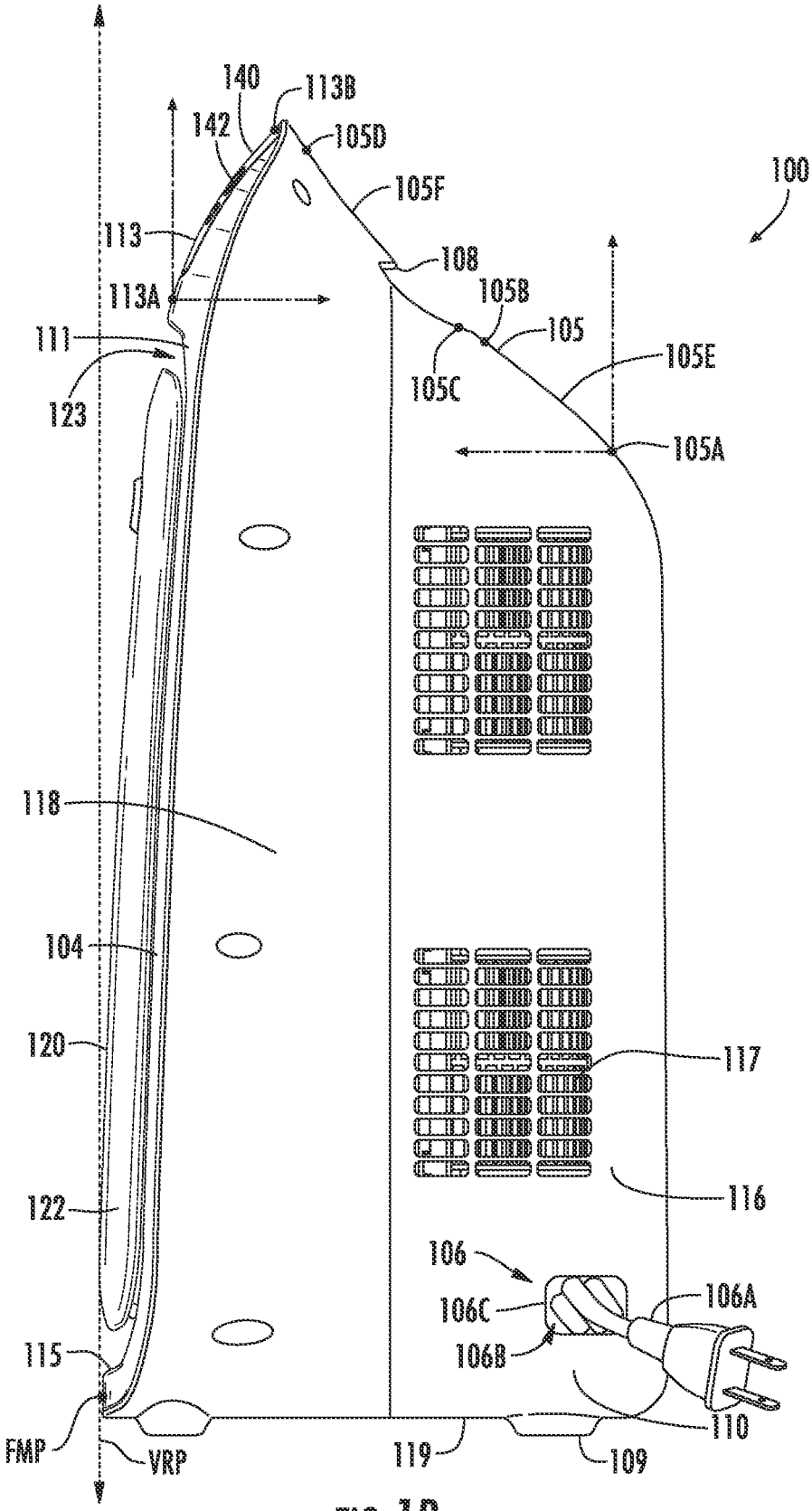
Figure 1C:
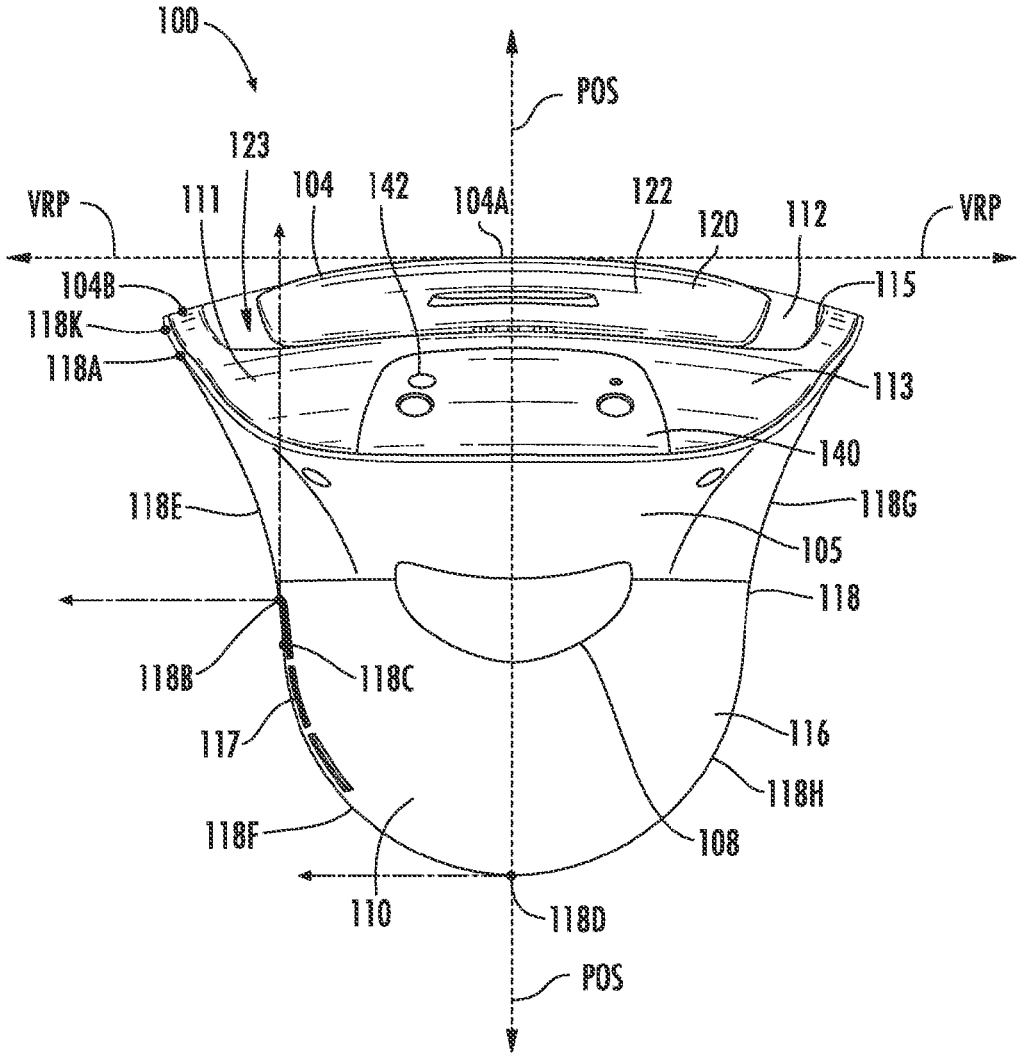
Figure 1D:
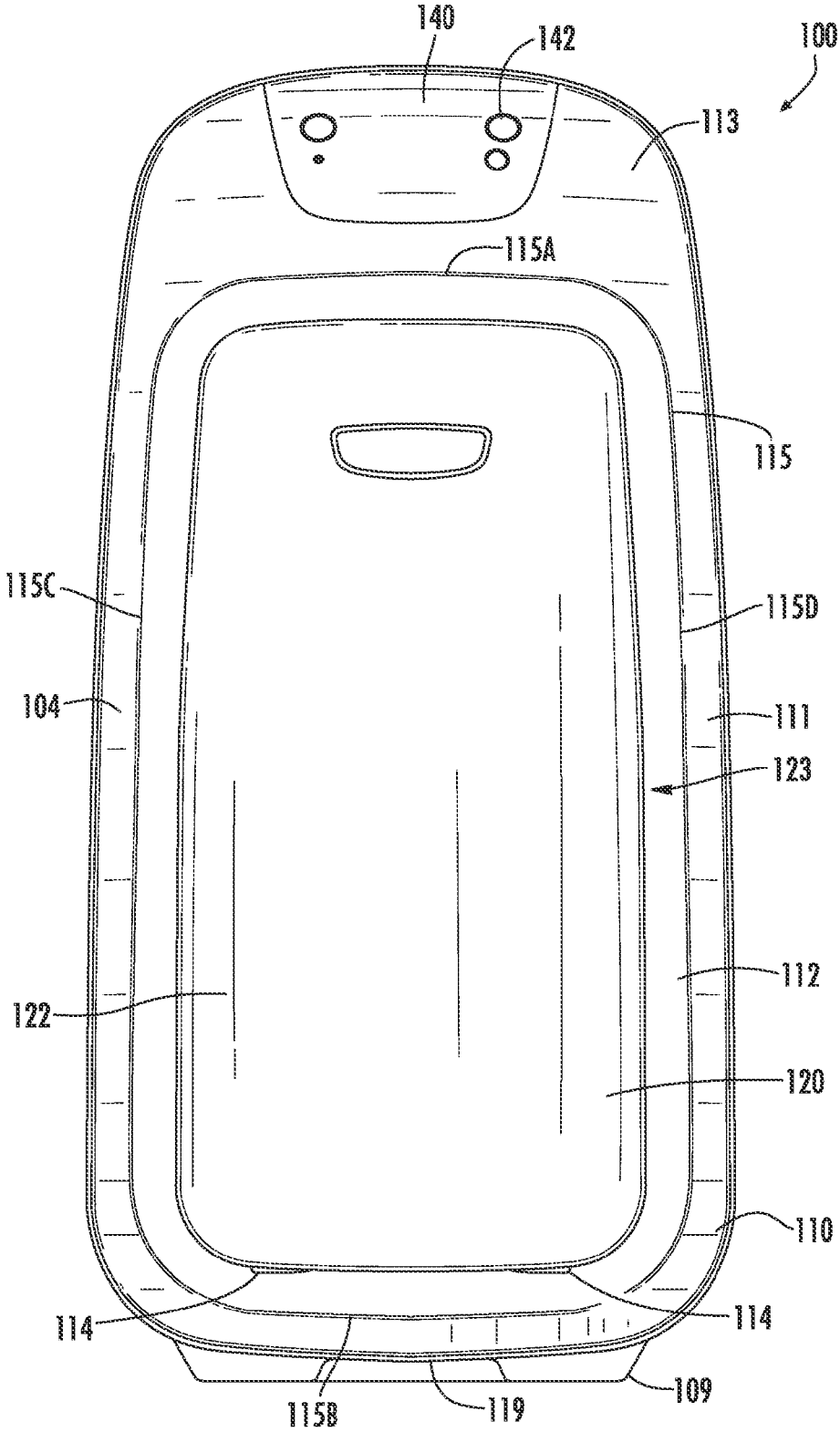
Figure 1E:
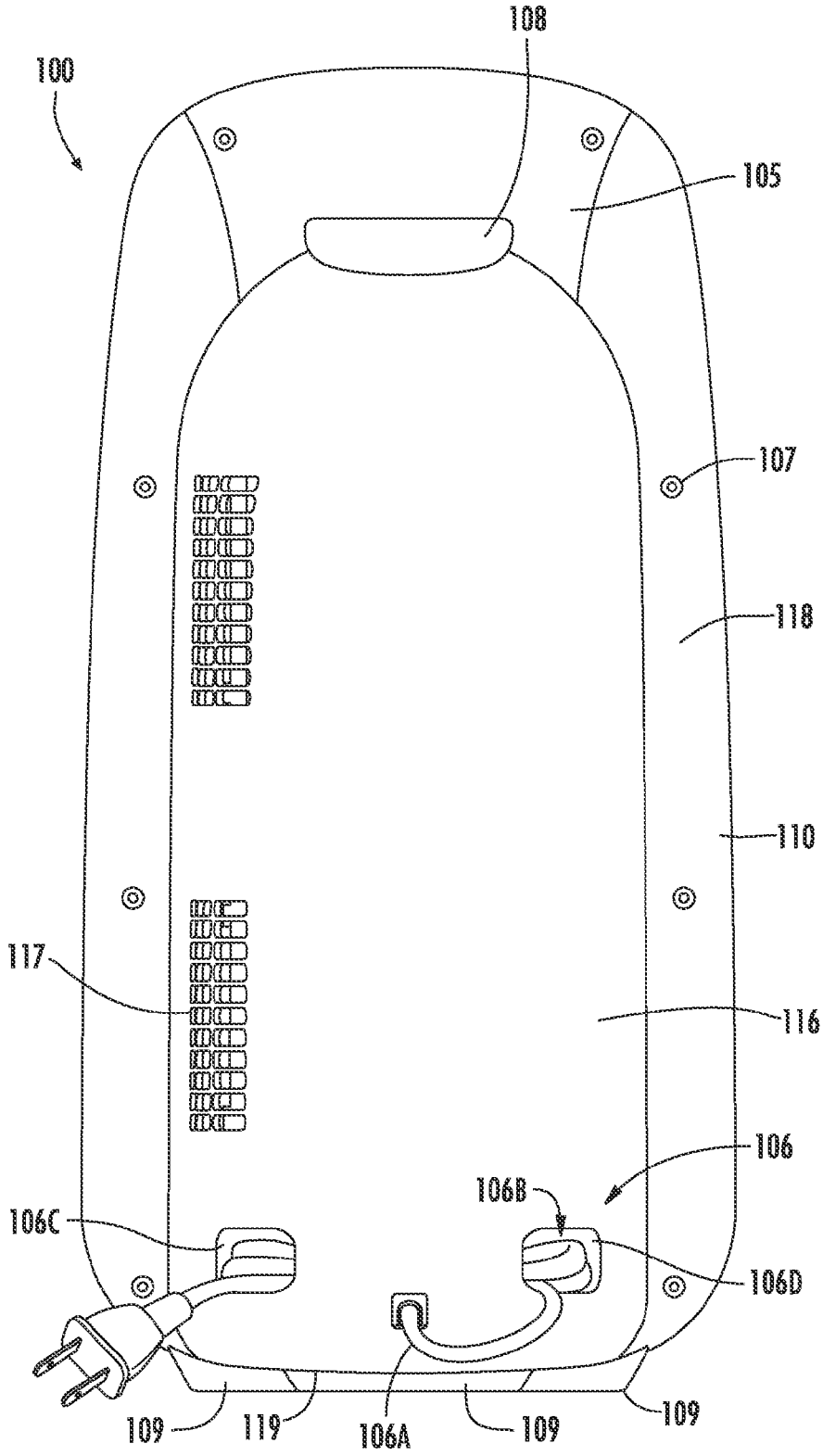
Figure 1F:
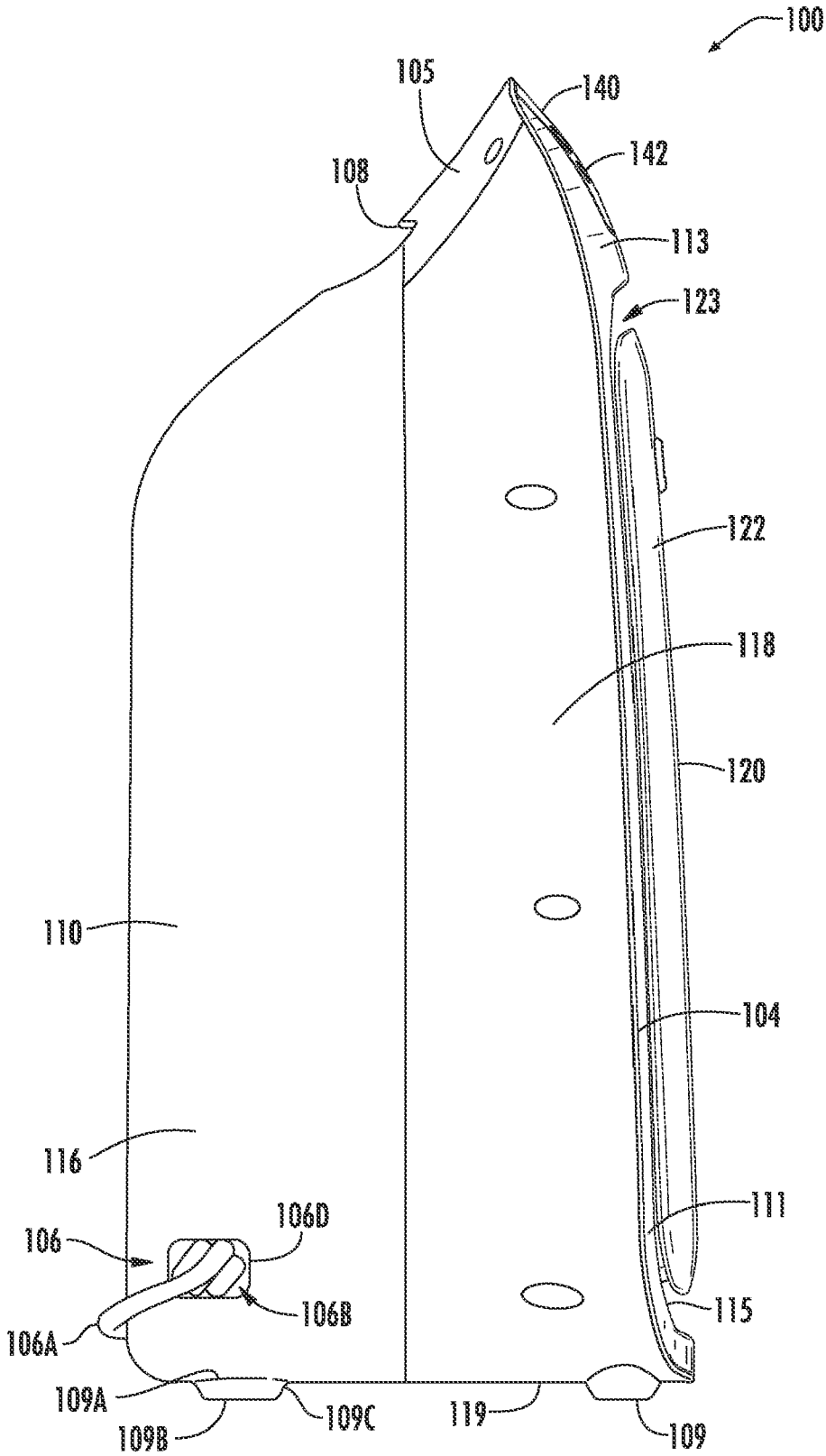
Figure 1G:
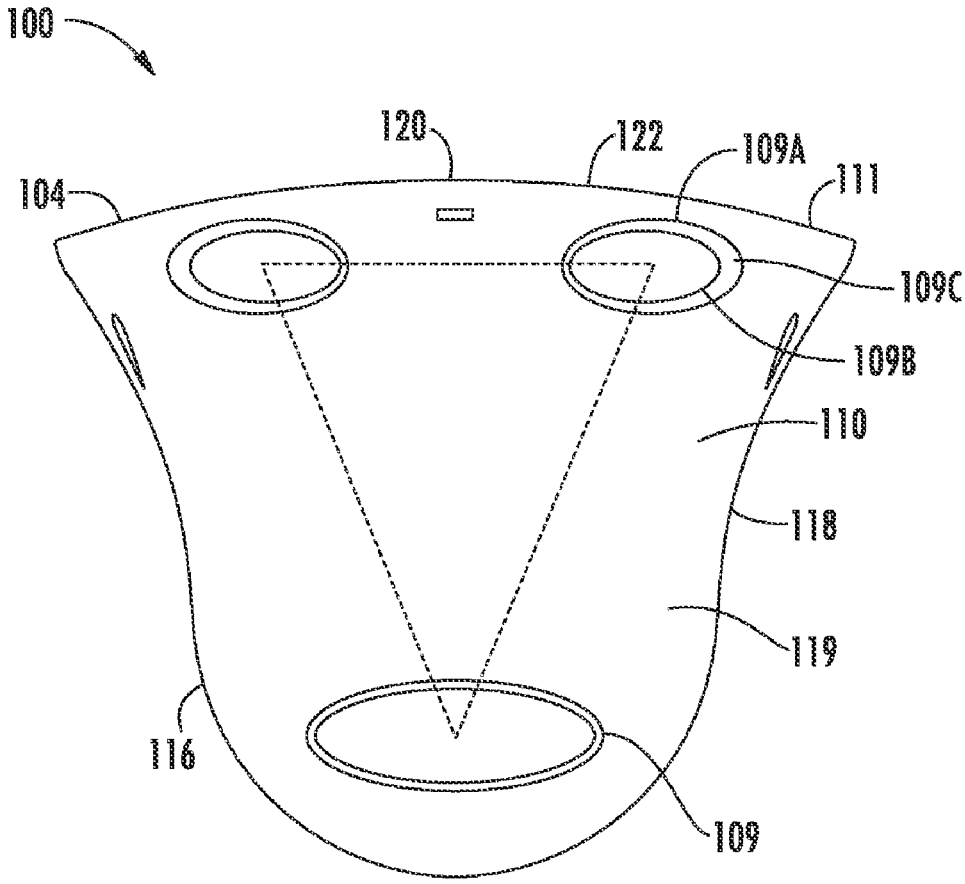
Figure 1H:
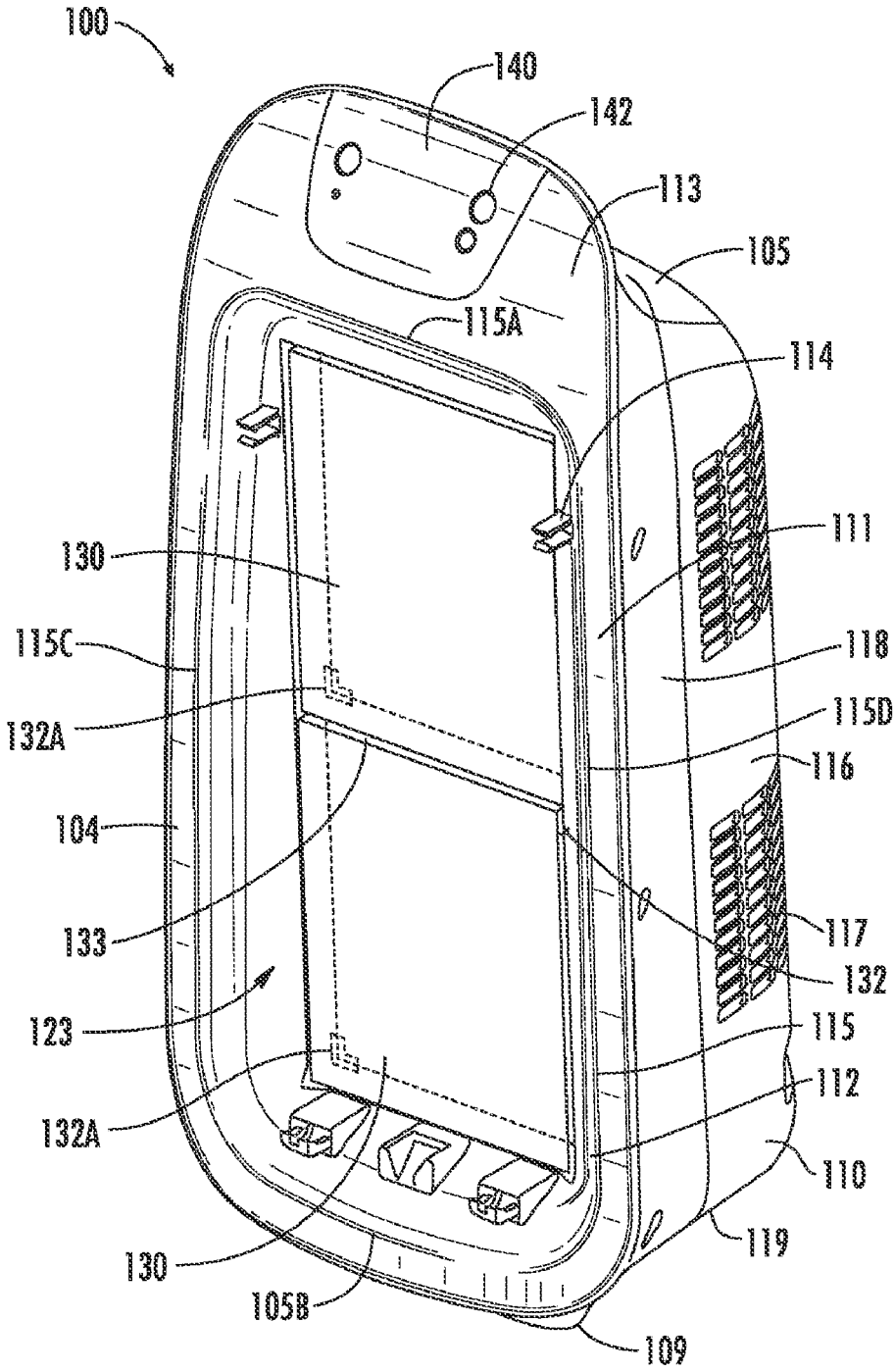
Figure 2A:
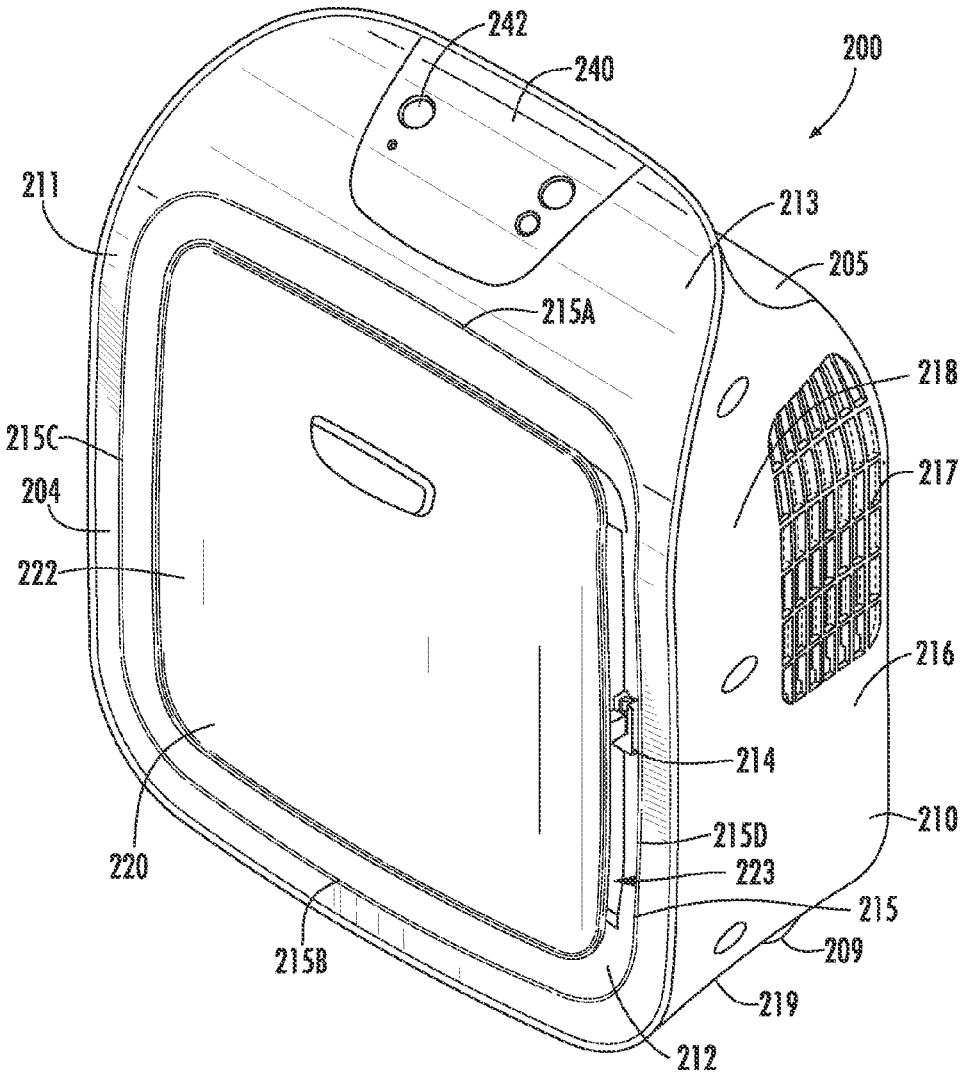
Figure 2B:
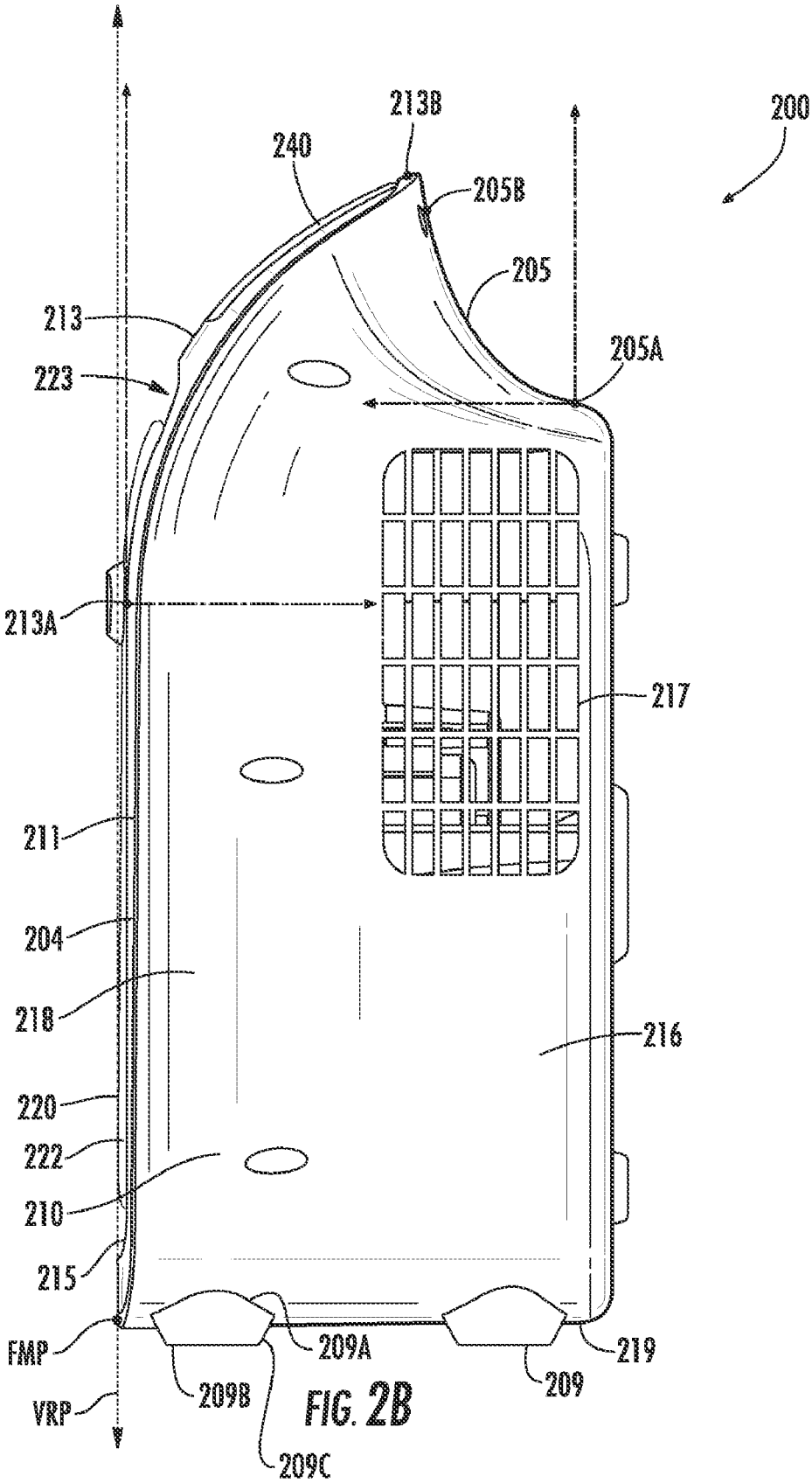
Figure 2C:
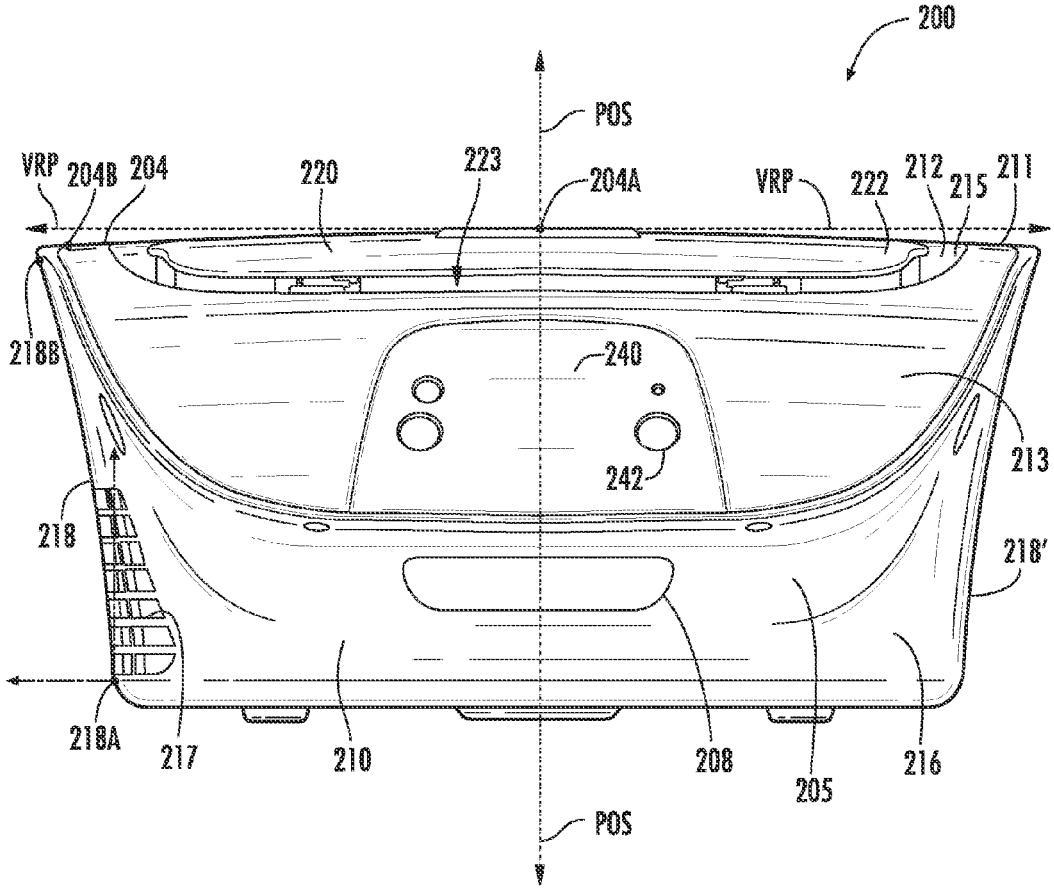
Figure 3A:
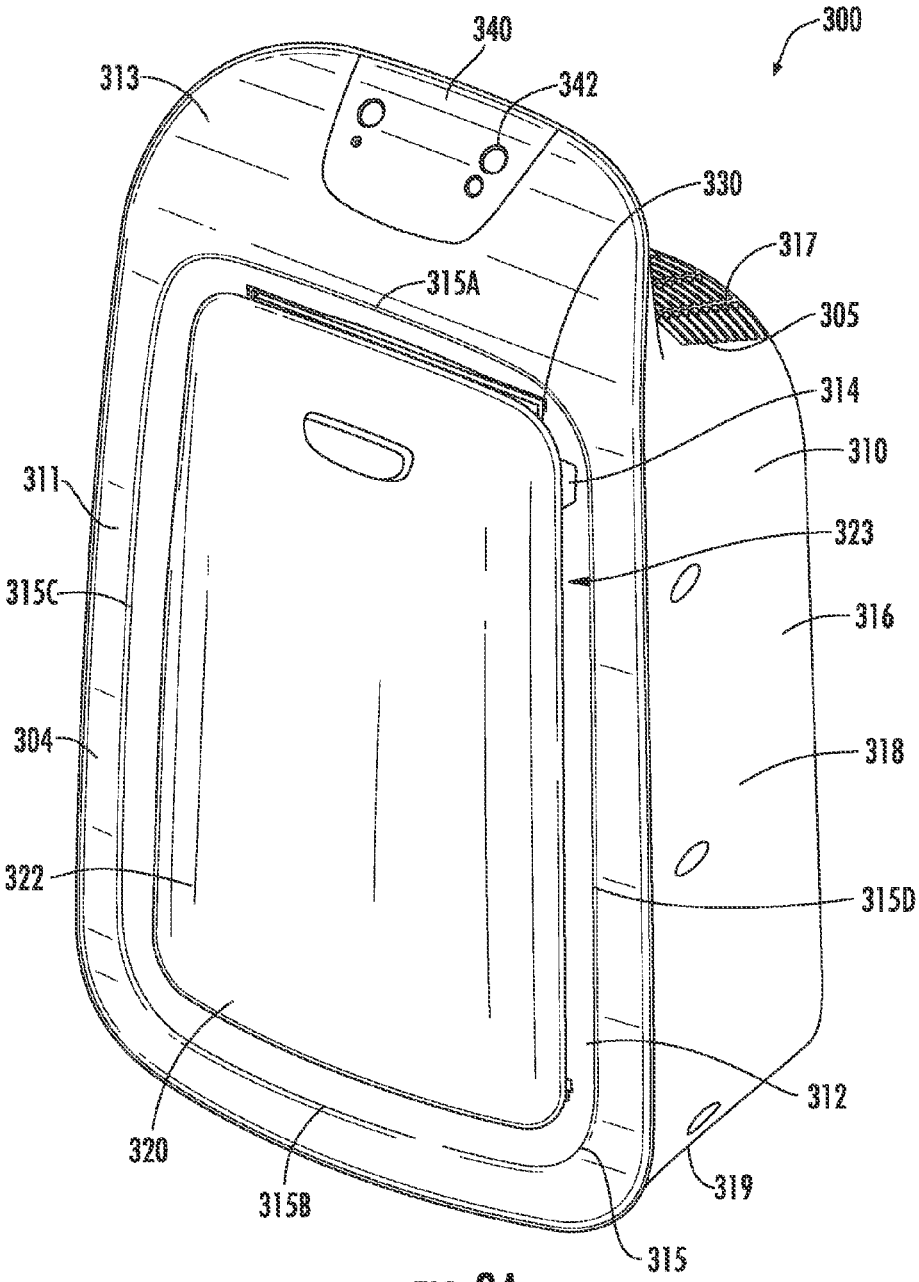
Figure 3B:
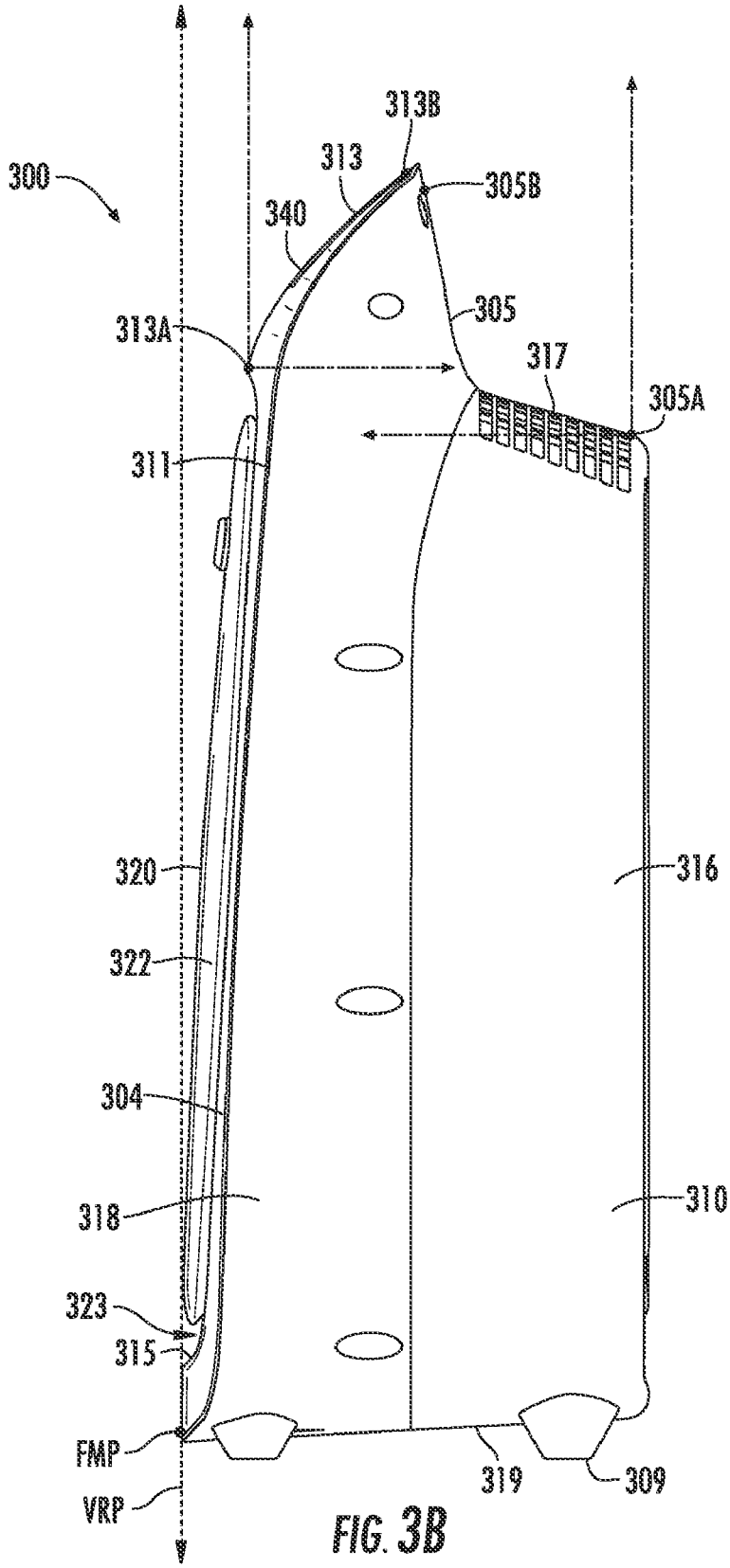
Figure 3C:
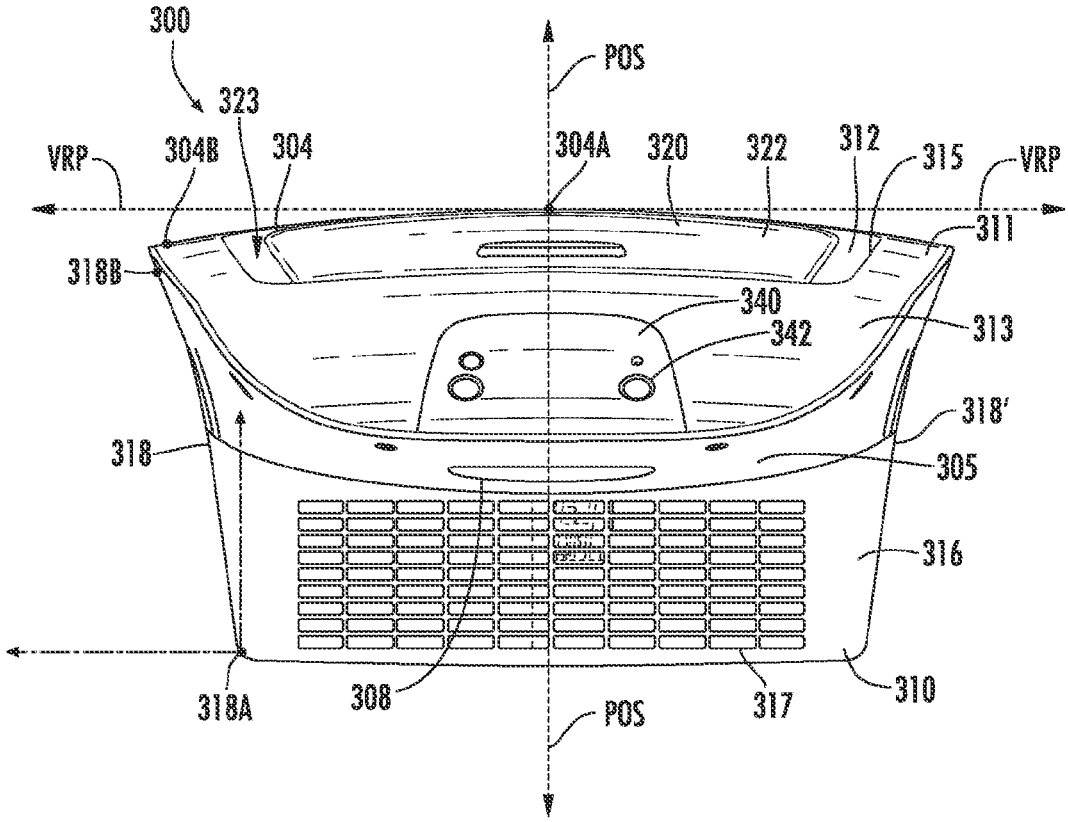
Figure 4A:
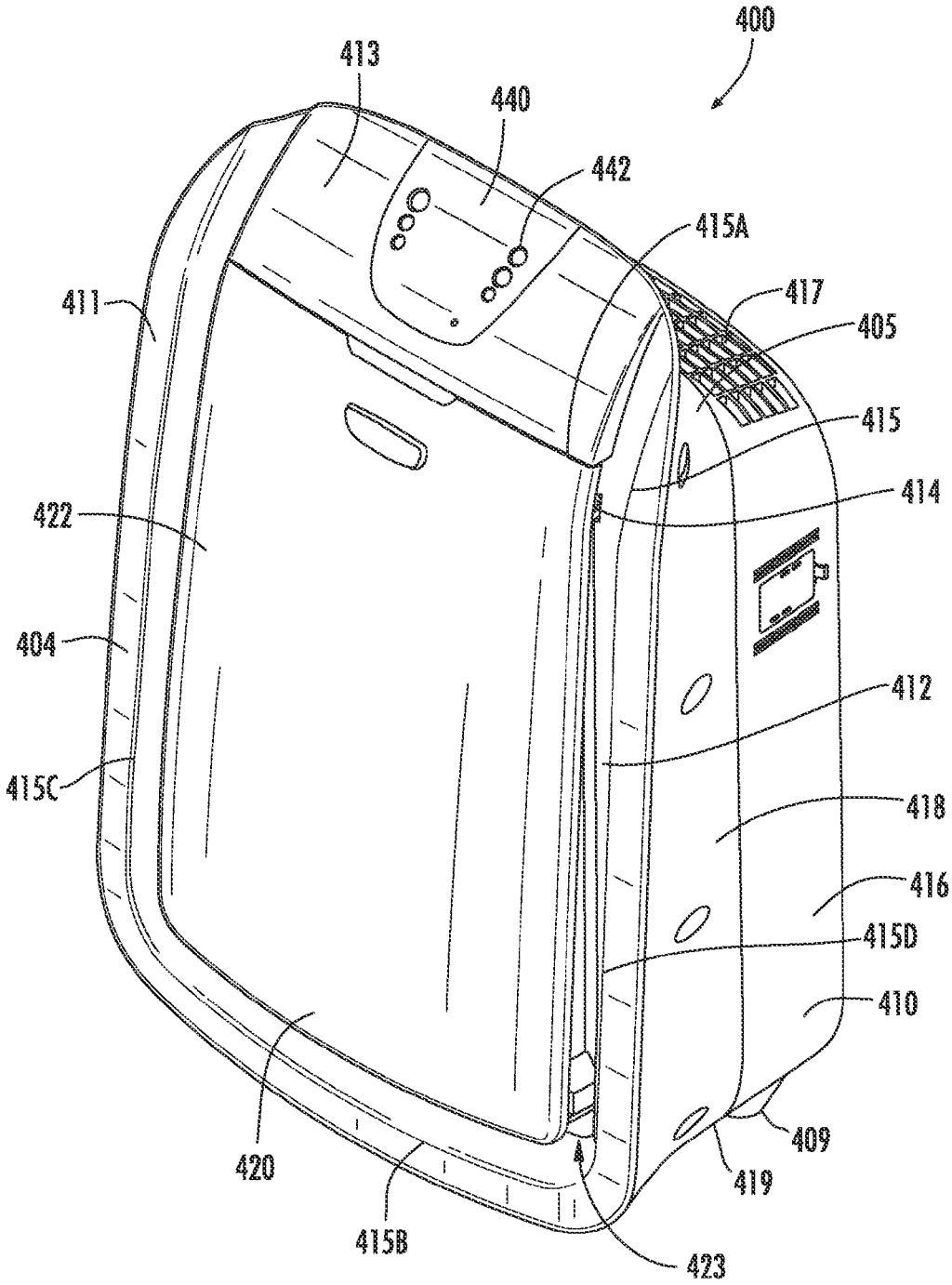
Figure 4B:
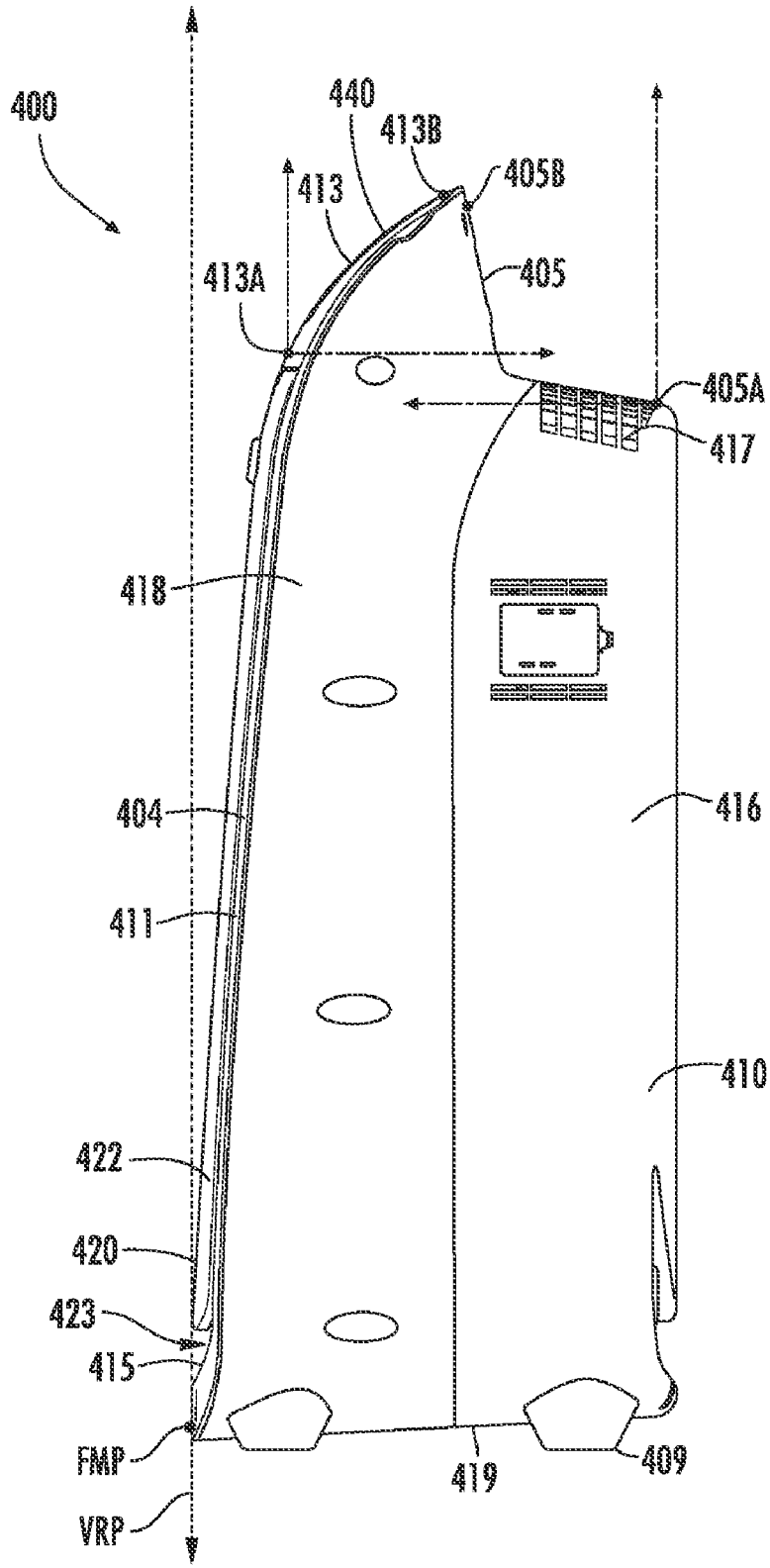
Figure 4C:
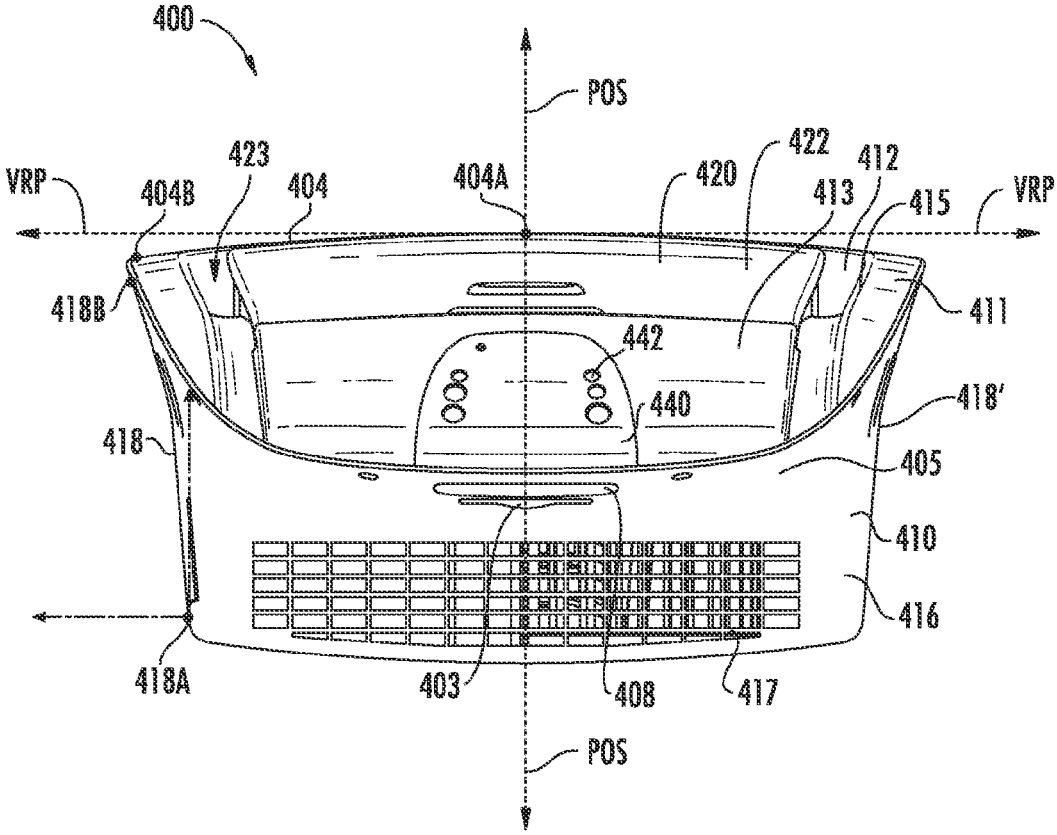
Figure 4D:
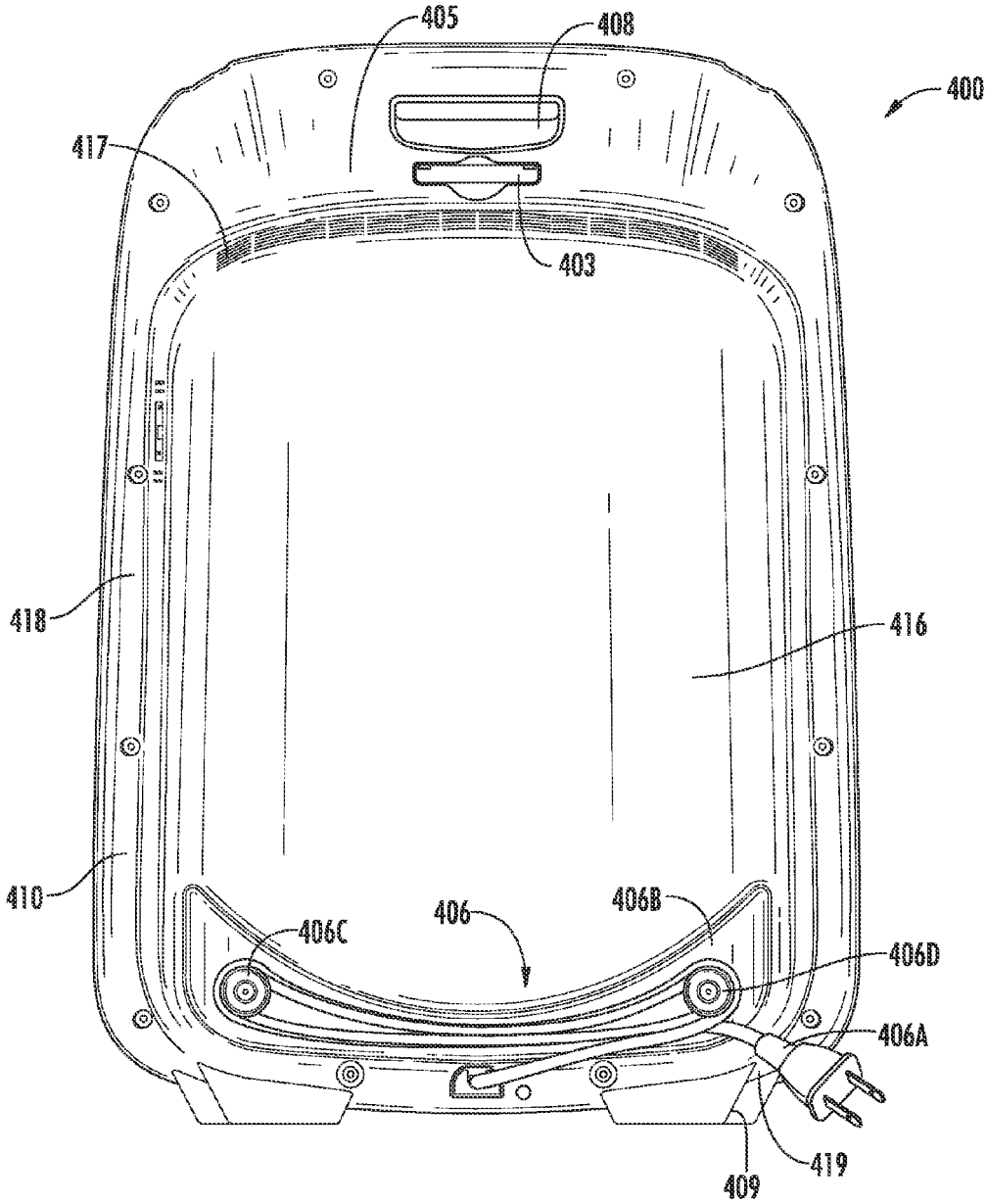
Figure 5A:
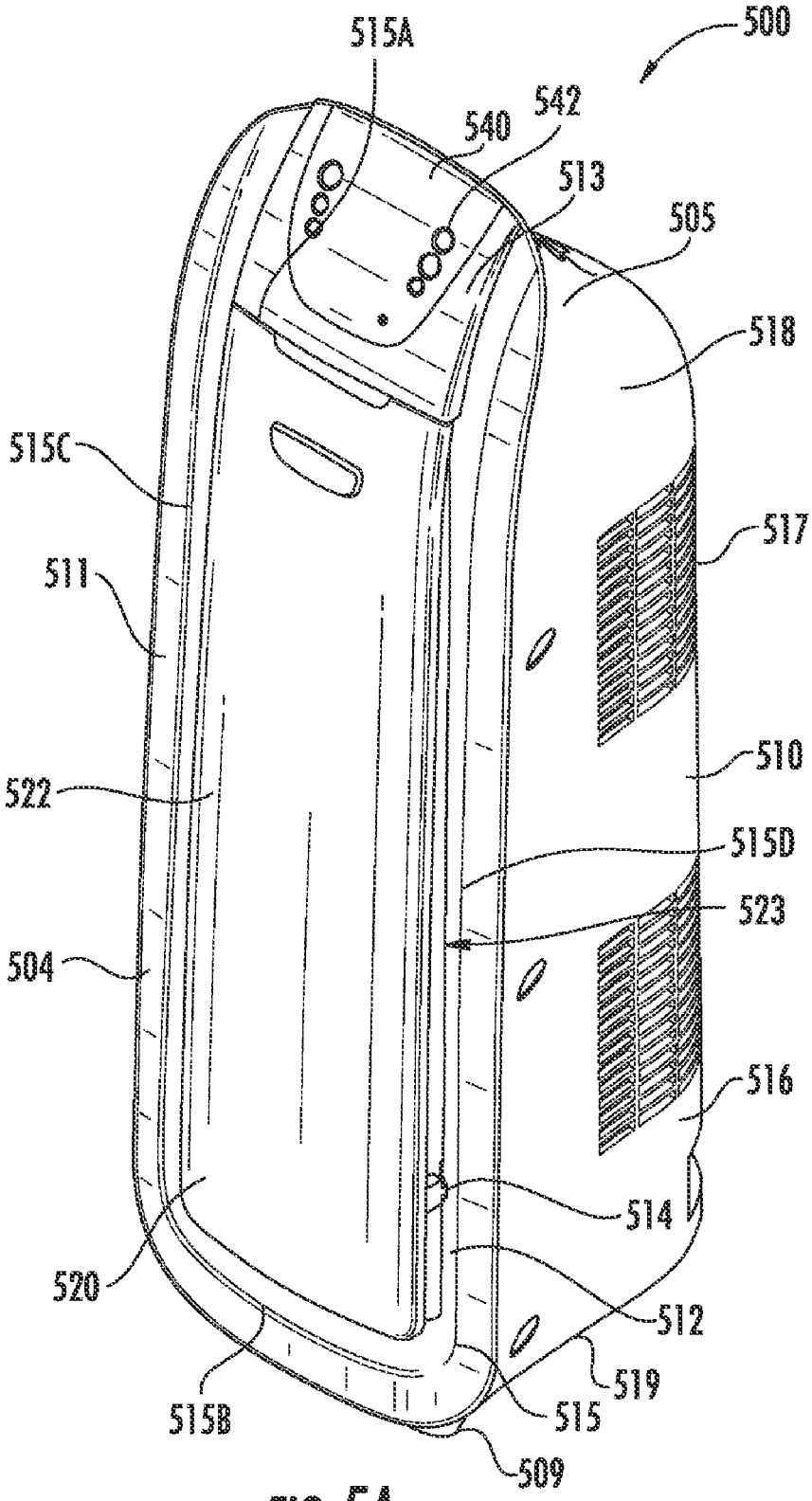
Figure 5B:
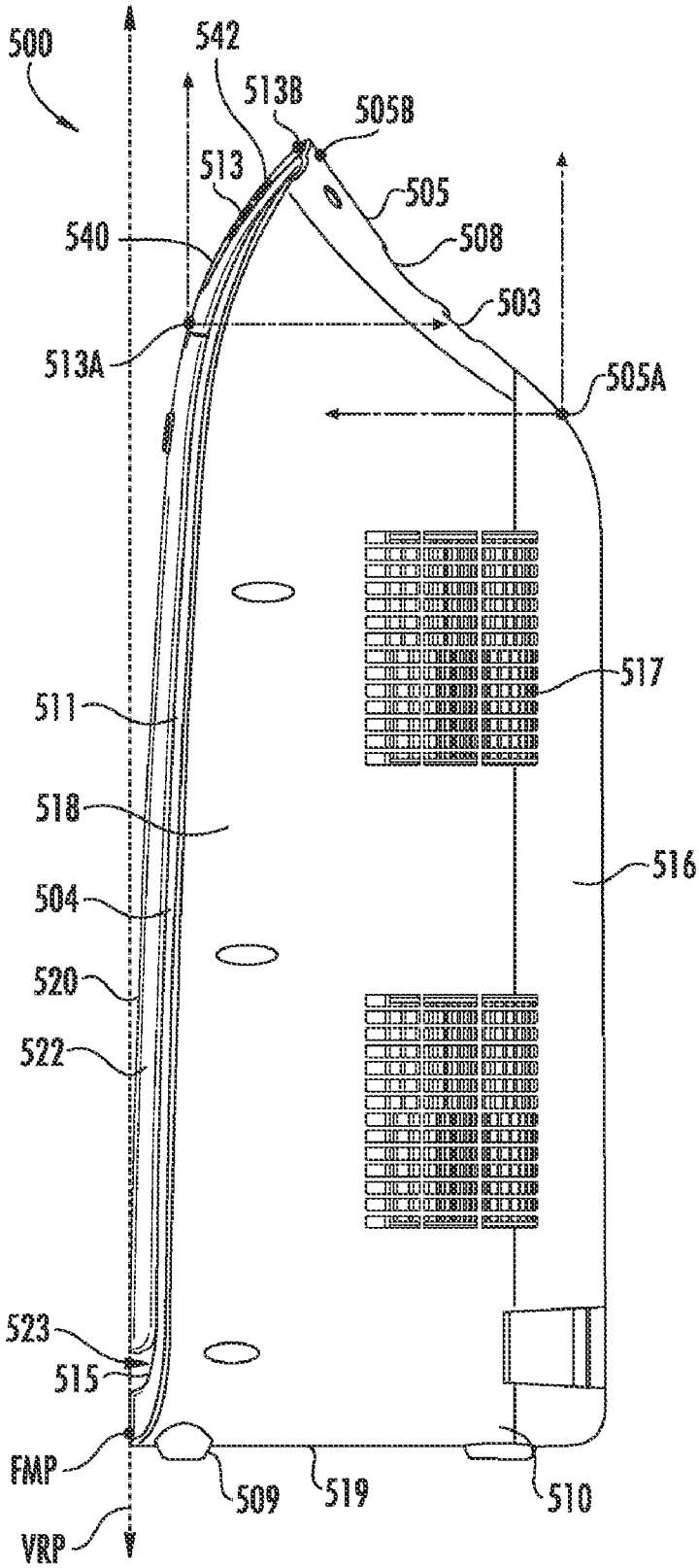

Having thus described embodiments of the invention in general terms, reference will now be made to the accompanying figures, which are not necessarily drawn to scale, and wherein:

FIG. 1A illustrates a top, front, and right side perspective view of a first embodiment of an air treatment device;

FIG. 1B illustrates a right side elevational view of FIG. 1A;

FIG. 1C illustrates a top plan view of FIG. 1A;

FIG. 1D illustrates a front elevational view of FIG. 1A;

FIG. 1E illustrates a rear elevational view of FIG. 1A;

FIG. 1F illustrates a left side elevational view of FIG. 1A;

FIG. 1G illustrates a bottom plan view of FIG. 1A;

FIG. 1H illustrates a top, front, and right side perspective view of the embodiment of FIG. 1A without the cowling;

FIG. 2A illustrates a top, front, and right side perspective view of a second embodiment of an air treatment device;

FIG. 2B illustrates a right side elevational view of FIG. 2A;

FIG. 2C illustrates a top plan view of FIG. 2A;

FIG. 3A illustrates a top, front, and right side perspective view of a third embodiment of an air treatment device;

FIG. 3B illustrates a right side elevational view of FIG. 3A;

FIG. 3C illustrates a top plan view of FIG. 3A;

FIG. 4A illustrates a top, front, and right side perspective view of a fourth embodiment of an air treatment device;

FIG. 4B illustrates a right side elevational view of FIG. 4A;

FIG. 4C illustrates a top plan view of FIG. 4A;

FIG. 4D illustrates a rear elevational view of FIG. 4A;

FIG. 5A illustrates a top, front, and right side perspective view of a fifth embodiment of an air treatment device;

FIG. 5B illustrates a right side elevational view of FIG. 5A; and

Figure 5C:
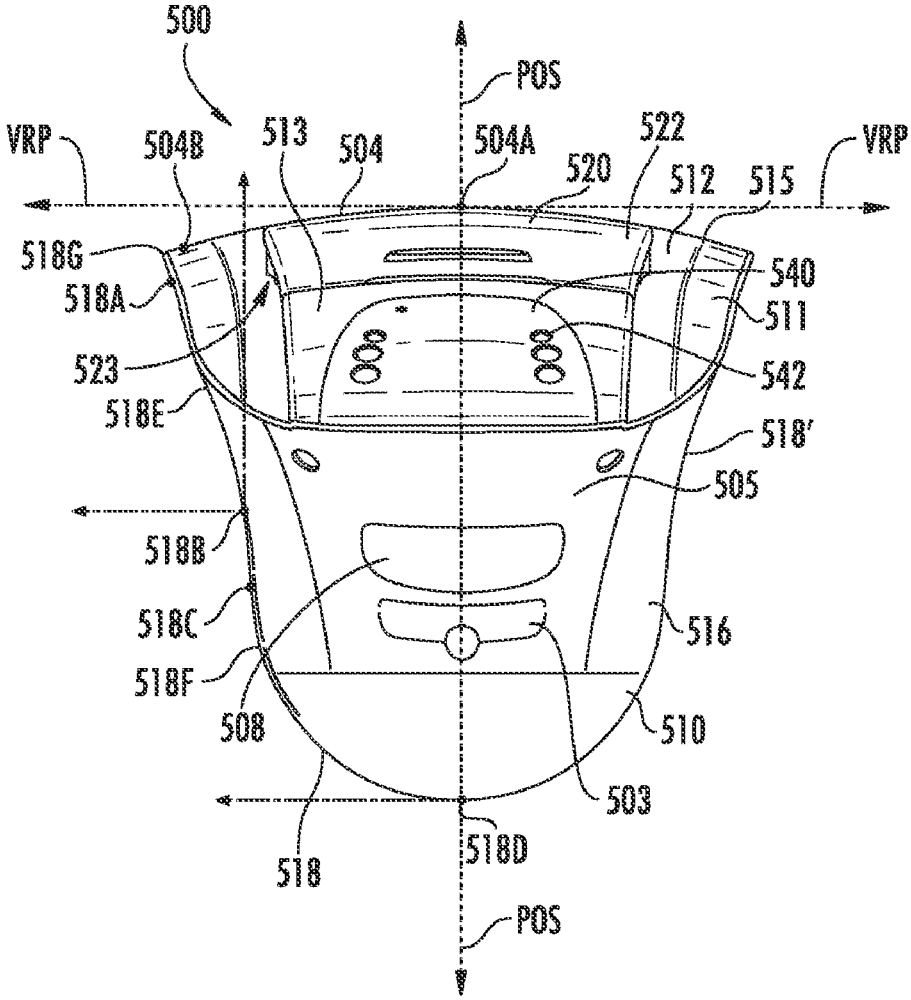

FIG. 5C illustrates a top plan view of FIG. 5A.

DETAILED DESCRIPTION OF EMBODIMENTS OF THE PRESENT INVENTION

Embodiments of the present invention now will be described more fully herein with reference to the accompanying drawings, in which some, but not all, embodiments of the invention are shown. Indeed, the present invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form, and vice versa. Also, as used herein, the terms "a" and/or "an" shall mean "one or more," even though the phrase "one or more" is also used herein. Like numbers and letters refer to like elements throughout.

It will be understood that in most of the embodiments described herein, the air treatment device is for air purification purposes and has a housing comprising an air inlet and an air outlet, a fan assembly positioned within the housing for directing air into the air inlet and out of the air outlet, and a purification system positioned within the housing for at least partially purifying, filtering, and/or cleaning the air that enters the device. In these embodiments, the purification system may comprise, for example, any one or more of the following: one or more filters, such as one or more high efficiency particulate air (HEPA) filters, carbon filters, and/or pre-filters; one or more photocatalytic oxidation purification systems; one or more ultraviolet (UV) light purification systems, such as UV-C bulb systems and/or ultraviolet germicidal irradiation (UVGI) systems; and/or one or more air and/or liquid ionizer purification systems, etc. Additionally, it will be understood that one or more embodiments of the present invention may have clean air delivery rates (CADRs) of 100, 125, 150, 200, and/or 280, as certified by the Association of Home Appliance Manufacturers (AHAM). At the same time, it will also be understood that some embodiments of the present invention may be used for purposes other than, or in addition to, air purification, including, for example, circulation, ventilation, blowing, heating, cooling, humidifying, and/or dehumidifying of air.

Referring now to a more detailed example, FIGS. 1A-1H provide various views of a housing 110 for an air treatment device 100, in accordance with an embodiment of the present invention. As shown in one or more of these views, the air treatment device 100 comprises a housing 110, a cowling 120, one or more filters 130, and a control display 140. The housing 110 further comprises a front portion 111 comprising a first front curvature 113, a second front curvature 104, and an air inlet 123 comprising a recessed portion 112. The recessed portion 112 comprises one or more connectors 114 and upper, lower, and opposed side edges 115A-115D. The housing 110 also comprises a rear portion 116 comprising one or more air outlets 117, a first rear curvature 105, a second rear curvature 118 comprising first, second, third, and fourth curvature regions 118E-118H, a power cord management system 106, one or more fasteners 107, a handle 108, and a bottom portion 119 comprising one or more bases 109. The power cord management system 106 further comprises a power cord 106A and a slot 106B comprising a first slot portion 106C and a second slot portion 106D. The power cord managements system is discussed in greater detail below. The control display 140 further comprises one or more control display buttons 142.

It will be understood that the housing 110 of the air treatment device 100 is the body in which most of the components of the air treatment device 100 are positioned. In some embodiments, the housing 110 is plastic and is assembled using a plurality of fasteners. However, in other embodiments, the housing 110 may be formed from and/or assembled with any other materials and/or objects sufficient to support the components and/or perform the functions of the air treatment devices described herein.

It will also be understood that the housing 110 may be configured differently in other embodiments to perform the same or similar functions described herein. As one example, in some embodiments, the air treatment device 100 may be arranged so that the recessed portion 112, with or without the cowling 120, can define an air outlet, and/or the features that define air outlet 117 may serve as an air inlet.

As illustrated, the housing 110 of the embodiment illustrated in FIGS. 1A-1H has a first front curvature 113 that is positioned at least partially above the recessed portion 112 on the front portion 111. In other embodiments, the first front curvature 113 may be positioned at least partially alongside, below, and/or within the recessed portion 112 and/or vice versa. As shown in FIG. 1B, the first front curvature 113 extends from the first point 113A positioned near a central region of front portion 111 and continues upwardly and backwardly to a second point 113B positioned near a top perimeter of the front portion 111.

As a source of reference only, FIG. 1B also depicts a vertical reference plane VRP, which may be defined at an exemplary forward-most point FMP on the front portion 111. In some embodiments, as shown in FIG. 1B, the first front curvature 113 curves further away from the vertical reference plane VRP as the front portion 111 extends vertically upwards in a direction away from the bottom portion 119. Additionally, the front portion 111 may be configured so that the first front curvature 113 diverges away from the vertical reference plane VRP at a more pronounced or substantial rate than the rest of the front portion 111. Further, in some embodiments, the first front curvature 113 curves around a generally horizontal axis positioned in the housing 110, such that the first front curvature 113 may be characterized as convex as viewed from the exterior of the housing 110.

As shown in FIG. 1C, in some embodiments, the first front curvature 113 may also extend laterally outwardly and backwardly. The first front curvature 113 may be generally symmetrical about a plane of symmetry POS that runs through the middle of the housing 110 and that is generally perpendicular to the vertical reference plane VRP. The first front curvature 113 of one embodiment curves backwardly so as to diverge further away from the vertical reference plane VRP as the front portion 111 extends laterally away from the plane of symmetry POS. The first front curvature 113 presents an aesthetically pleasing shape and tends to make the housing 110 appear less imposing or obtrusive than it would appear without the first front curvature 113. The first front curvature 113 also provides a convenient-to-view and convenient-to-access location for at least a portion of the control display 140.

The control display 140 has one or more control display buttons 142 that allow a user to control one or more aspects of the air treatment device 100, including, for example, various fan speeds, sleep timers, clocks, various rotation settings, and/or various mode settings, etc. It will be understood that the control display button(s) 142 may include one or more pushbuttons, knobs, haptic interfaces, and/or anything else that allows users to control at least one aspect of the air treatment device 100. In some embodiments, the control display 140 may also include control functions for one or more air characteristic sensors (e.g., air quality sensors, air humidity sensors, air temperature sensors, etc.), replace filter indicators, UV light purification sensors, and/or remote control sensors, etc. that may be part of the air treatment device. The control display 140 may also output information in one or more ways, including via liquid crystal displays (LCDs), light emitting diodes (LEDs), digital displays, analog displays, video displays, laser displays, segment displays, electronic displays, and/or any other visual displays, etc.

In many embodiments, the control display 140 comprises an outer curvature that generally conforms to the shape of the first front curvature 113, such that the display 140 is generally viewable from a position in front of the display and a position above the display. In this configuration, at least one of the control buttons on the control display 140 is also viewable in these directions, making it easy for a user to view and access. It will be understood that other embodiments may include a control display having a different type, size, shape, and/or positioned in a different location than that of the control display 140 depicted in FIGS. 1A-1H.

Referring now to FIG. 1C, the housing 110 comprises a second front curvature 104 extending from a first point 104A positioned near a central region of the front portion 111 and continuing laterally outwardly and backwardly (away from the vertical reference plane VRP) to a second point 104B positioned near an outer perimeter of the front portion 111. In many embodiments, including the one shown in FIG. 1C, the second front curvature 104 also extends from the first point 104A laterally outwardly and backwardly in a direction generally opposite from the second point 104B, such that the second front curvature 104 is generally symmetrical about the plane of symmetry POS that runs through the middle of the housing 110 and that is generally perpendicular to the bottom portion 119. In some embodiments, the second front curvature 104 curves around a generally vertical axis positioned in the housing 110, such that the second front curvature 104 may be characterized as convex as viewed from the exterior of the housing 110. Also in some embodiments, as shown in FIG. 1B, the second front curvature 104 may curve further away from the vertical reference plane VRP as the front portion 111 extends laterally away from the plane of symmetry POS and also as it extends vertically up in a direction away from the bottom portion 119.

Referring again to FIG. 1B, the housing 110 also comprises a first rear curvature 105 that is positioned generally near a top of the rear portion 116. As shown, the first rear curvature 105 extends from a first point 105A positioned near a rear perimeter of the rear portion 116 and continues upwardly and forwardly to a second point 105D near a top perimeter of the rear portion 116. In some embodiments, the second point 113B of the front portion 111 and the second point 105D may be positioned in the same location on the housing 110.

In this particular embodiment, the first rear curvature 105 comprises two curvature regions 105E and 105F, but in other embodiments, the first rear curvature 105 may include more or fewer curvature regions. The first curvature region 105E of the first rear curvature 105 extends from the first point 105A positioned near the rear perimeter of the rear portion 116 and continues upwardly and forwardly to a second point 105B positioned on the perimeter of rear portion 116. The first curvature region 105E curves around a generally horizontal axis positioned within the housing, such that the region 105E may be characterized as convex as viewed from the exterior of the housing 110. The second curvature region 105F of the first rear curvature 105 extends from a third point 105C on the perimeter of the rear portion 116 and continues upwardly and forwardly to a fourth point 105D positioned near a top perimeter of the rear portion 116. The second curvature region 105F curves around a generally horizontal axis positioned outside of the housing, such that the region 105F may be characterized as concave as viewed from the exterior of the housing 110.

In some embodiments, the second point 105B and the third point 105C may be positioned at the same location on the perimeter of the rear portion 116. Also in some embodiments, as shown in FIGS. 1B and 1C, the first rear curvature 105 may also extend outwardly and forwardly (or flare), such that the first rear curvature 105 is generally symmetrical about the plane of symmetry POS that runs through the middle of the housing 110 and is generally perpendicular to the bottom portion 119. Further, in some embodiments, the first rear curvature 105 curves around a generally horizontal axis positioned outside of the housing 110, such that the first rear curvature 105 as a whole may be characterized as concave as viewed from the exterior of the housing 110.

As also shown in FIG. 1C, the housing 110 also comprises a second rear curvature 118 that is positioned on the rear portion 116 and, when viewed from above the housing 110, generally resembles a bell-shaped curve. In some embodiments, as shown in FIG. 1C, the second rear curvature 118 flares outwardly as it approaches the front portion 111. Also, in this particular embodiment, the second rear curvature 118 includes four curvature regions 118E-118H, but in other embodiments, the second rear curvature 118 may include more or fewer curvature regions. These four illustrated curvature regions 118E-118H define exterior side walls of the rear portion 116 that extend rearward from the front portion 111 of the housing 110 and converge to define the rear portion 116 of the housing 110. The first region 118E of the second rear curvature 118 extends from a first point 118A positioned at or near a junction of the front and rear portions 111, 116 and continues rearward to a second point 118B positioned on the perimeter of rear portion 116. The first curvature region 118E curves around a generally vertical axis positioned outside of the housing, such that the region 118E may be characterized as concave as viewed from the exterior of the housing 110. The second curvature region 118F of the second rear curvature 118 extends from a third point 118C on the perimeter of the rear portion 116 and continues rearward to a fourth point 118D positioned near a furthermost rear point on the rear portion 116. The second curvature region 118F curves around a generally vertical axis positioned in the housing 110, such that the region 118F may be characterized as convex as viewed from the exterior of the housing 110.

In some embodiments, the second point 118B and the third point 118C may be positioned at the same location on the perimeter of the rear portion 116. Further, as illustrated in FIG. 1C, the first point 118A may be located at the junction of the front and rear portions 111, 116 and/or there may be a fillet 118K between the first point 118A and the front portion 111.

In the illustrated embodiment of FIGS. 1A-1H, at least a portion of the first rear curvature 105 and at least a portion of the second rear curvature 118 are positioned between the air outlet 117 and the air inlet 123. This helps deflect air from the air outlet 117 generally away from the air inlet 123 and tends to prevent or inhibit air flowing out of the air outlet 117 from immediately reentering the air inlet 123 of the housing 110. For example, as shown in many of the FIGS. 1A-1H, the air outlet 117 is located on the second curvature region 118F defined between points 118B and 118D of the second rear curvature 118. Accordingly, in this embodiment, one or more of the first rear curvature 105, the first curvature region 118E, the second curvature region 118F, and/or a combination of the two curvature regions 118E, 118F inhibit air escaping the air outlet 117 from immediately reentering the housing 110 through the air inlet 123.

In some embodiments, including the one shown in FIGS. 1A-1H, the first and second curvature regions 118E, 118F of the second rear curvature 118 are positioned on a first side of the rear portion 116 of the housing 110. In some embodiments, the opposed second side of the rear portion 116 includes the third and fourth curvature regions 118G, 118H, and those curvature regions 118G, 118H are configured so that they generally mirror the first and second curvature regions 118E, 118F. In these embodiments, the rear portion 116 has a generally bell-shaped curvature that is generally symmetrical about the plane of symmetry POS that runs through the middle of the housing 110 and that is generally perpendicular to the bottom portion 119.

Further, it will be understood that, in some embodiments, the second rear curvature 118, like the first front curvature 113, second front curvature 104, and/or first rear curvature 105, may extend through one or more planes generally parallel to the bottom portion 119, through one or more planes generally perpendicular to the bottom portion 119, and/or through one or more planes in between. Accordingly, in some embodiments, including the one shown in FIGS. 1A-1H, the first front curvature 113 may smoothly transition into the second front curvature 104 and/or vice versa, and/or the first rear curvature 105 may smoothly transition into the second rear curvature 118 and/or vice versa. Because of the contours and positions of these curvatures, the housing 110 is aesthetically pleasing and helps an air treatment device 100 appear slim from front to back and/or from side to side. It is noted that other embodiments of the present invention may include the same and/or one or more additional curvatures extending in more, fewer, and/or different directions.

As shown in many of the FIGS. 1A-1H, the front portion 111 of the housing 110 also comprises an air inlet 123 through which air enters the air treatment device 100. In one embodiment, the air inlet 123 comprises the recessed portion 112 comprising upper, lower, and opposed side edges 115A-115D, and in some embodiments, as shown in FIG. 1H, the air inlet 123 also comprises one or more filters 130. Further, in some embodiments, a cowling 120 is releasably connected to the housing 110 via one or more connector(s) 114 to at least partially define the air inlet 123. The cowling 120 may also generally cover one or more filter(s) 130 located in the air inlet 123. In the embodiment of the housing 110 illustrated FIGS. 1A-1H, the cowling 120 is positioned relative to the recessed portion 112, such that together the cowling 120 and the edges 115A-115D of the recessed portion 112 define a quasi-rectangular and quasi-O-shaped opening to the air inlet 123 for air to enter the housing 110. In other embodiments, however, the opening may be of a different size and/or shape, including, for example, the quasi-U-shaped openings shown in the embodiments illustrated in FIGS. 4 and 5 and discussed further herein.

In some embodiments, as shown in many of the views of the housing 110, the cowling 120 has a cowling curvature 122. In some embodiments, when the cowling is releasably connected to the housing 110, the cowling curvature 122 curves around a generally vertical axis positioned in the housing 110, such that the cowling curvature 122 may be characterized as convex as viewed from the exterior of the housing 110. In another embodiment, the cowling curvature 122 curves around a generally horizontal axis positioned in the housing 110, such that the cowling curvature 122 may be characterized as convex as viewed from the exterior of the housing 110.

In some embodiments, the cowling curvature 122 may also be generally symmetrical about the plane of symmetry POS that runs through the middle of the housing 110. In still other embodiments, the cowling curvature 122 may also be generally symmetrical about other planes that are generally perpendicular to the bottom portion 119, generally parallel to the bottom portion 119, and/or about one or more planes in between. Further, as shown in FIGS. 1A-1C, the shape of the cowling curvature 122 may conform to the first front curvature 113 and/or the second front curvature 104, such that the cowling curvature 122 would smoothly transition into the first front curvature 113 and/or the second front curvature 104 if the opening to the air inlet 123 did not exist in the front portion 111 between the edges 115A-115D and the cowling 120. The cowling curvature 122 also complements the other curvatures 113, 104, 105, and 118 to achieve a functional housing shape that also is aesthetically pleasing, helps the air treatment device 100 appear more graceful and sleek, and provides the air treatment device 100 with a slim and less obtrusive appearance from front to back and/or from side to side.

Referring now to FIG. 1G, a bottom view of the housing 110 is depicted. The bottom portion 119 of the housing 110 comprises one or more bases or feet 109. The base or bases 109 are structured and positioned to support the housing 110 on a support surface. In some embodiments, the base or bases 109 are structured for proper placement on a mesh support surface such as a mezzanine floor or a display rack where the support surface comprises spaced apart holes. In these instances, improper spacing or sizing of a base or bases on the housing may cause one or more of the bases to be located in a hole of the perforated or mesh support surface causing the housing to not sit level on the support surface.

To address this issue, as depicted in FIG. 1G, in some embodiments, the housing 110 may include one or a plurality of bases 109 that are sized so as to have a dimension that is larger than a dimension of the holes in the support surface, such that the bases contact the edges of the holes in the support surface on which each base rests. Note, that many perforated or mesh support surfaces may have holes with multiple dimensions. For example, if the holes are square-shaped, the diagonal dimension of the hole will be larger than the side dimensions of the hole. As such, in some embodiments, the bases 109 are sized to be larger than the largest dimension of the holes of a given support surface to prevent the bases from inserting into the holes and making the housing unlevel. This allows the housing 110 to be placed in various orientations on the support surface while maintaining the housing 110 at a level orientation relative to the support surface.

As also depicted in FIG. 1G, in one embodiment, the housing 110 may include one or more bases 109 that are of a non-square or non-circular shape, such as oval in shape. This also allows the housing to be placed into different orientations on the mesh support surface in a level position, as the bases 109 are shaped and sized to span a dimension of the holes so as to rest on the edges of the holes in the support surface.

As also depicted in FIG. 1G, in one embodiment, the housing 110 may include one or more bases 109 that are spaced apart in a non-square or non-rectangular configuration. For example, as demonstrated by the dotted line the bases may be spaced in a triangular configuration. Other configurations such as trapezoidal, rhombus, etc. are contemplated.

As also depicted in FIGS. 1F and 1G, in one embodiment, the housing 110 may include one or more bases 109 that comprise a first end 109A for connection to the housing bottom portion 119 and a second opposed end 109B for contacting the support surface. The first and second opposed ends are spaced apart by one or more sidewalls 109C. The first end 109A has a larger lateral dimension than the second opposed end 109B, and the sidewalls 109C are tapered or drafted from the first end 109A to the second end 109B. In this manner, the first end 109A of each base can be placed further apart on the bottom portion 119 of the housing 110 and taper so as to create a smaller "foot print" for contacting the support surface.

As illustrated in FIGS. 1B, 1C, 1E, and 1F, the housing 110 includes a handle 108 for lifting and carrying the unit. In some embodiments, the handle 108 is positioned vertically, horizontally, or both vertically and horizontally relative to the distribution of weight of the materials and components on and inside each device, so that when each device is lifted by its handle 108 the device has very little, or no, tendency to pivot about the handle. This tends to keep each device substantially upright when being lifted and can make movement of the devices from one location to another much less clumsy and much less likely to result in tipping or bumping of the devices. Following the general concept that an object will balance when its center of gravity (i.e., the position where all of its mass, on the average, resides) is directly over or under the point of support, the weight of the unit is generally balanced relative to the placement of the handle 108.

Referring now to FIG. 1H, a perspective view of housing 110 is provided with the cowling 120 removed. As shown, the housing 110 includes four connectors 114 for releasably connecting the cowling 120 to the housing 110. In this embodiment, the connectors 114 are plastic clips for receiving corresponding portions of the cowling 120 (not shown), but other embodiments may include different types, sizes, and/or numbers of fasteners for performing the same function, and/or those fasteners may be positioned differently.

With the cowling 120 removed, FIG. 1H also illustrates two filters 130 positioned in the air inlet 123 within the housing 110. The filters 130 are arranged so as to purify air that passes in substantially the same direction through the filters 130. In this embodiment, the filters 130 are HEPA filters and one is positioned above the other and offset such that the front-facing surfaces of the filters 130 are not coplanar. This offset 132 may be achieved, for example, by appropriately disposing one or more filter stops 132A on an inside wall of the housing 110. The filter stops 132A may be molded or otherwise formed integrally with the housing 110 or may be added thereto. The filter stops 132A may be provided, for example, at different depths into the housing 110 or with differing thicknesses to provide the desired amount of offset 132.

The offset 132 allows at least one of the filter side surfaces 133 to protrude beyond the side surface of the other filter 130 when the filters 130 have substantially the same filter thickness. This configuration facilitates removal of the filters 130. For example, for peripherally supported (or perimeter-enclosed) filters, one or more exposed side surfaces 133 of each offset filter 130 provide a convenient and sturdy surface that may be gripped to pull out and remove the filter 130. The removal of one filter 130 in this manner leaves the side surface of the other filter 130 exposed to facilitate removal of that filter 130. This offset arrangement avoids the need for different thicknesses of filters or special moldings or finger holes on the sides of the filters 130. It also makes it less likely that, in the absence of such moldings or finger holes, a user will need to pinch the potentially dirty filter media in order to remove a filter 130 for replacement.

It will be understood that other embodiments may include different types, sizes, and/or numbers of filters, and/or those filters may be positioned differently. In addition and as mentioned previously, some embodiments may not have a filter or any purification system, depending on the intended use for the air treatment device.

FIG. 1H also illustrates that removing the cowling 120 leaves the recessed portion 112, filters 130, and the connectors 114 exposed and easily accessible for cleaning, maintaining, and/or removal from the housing 110. This aspect of this embodiment of the present invention is different from many conventional air treatment devices that are configured in ways that make them difficult to access, maintain, and/or clean. When the cowling 120 is removed, the illustrated arrangement presents fewer, if any, surfaces that are difficult to reach or clean when compared to conventional air treatment devices that employ, for example, louvers, inlet slits, grills, and/or other intricate features with small and difficult-to-reach dirt-collecting surfaces.

Referring again to FIGS. 1B, 1E, and 1F, the housing 110 also comprises a power cord management system 106, in accordance with an embodiment of the present invention. As shown, the power cord management system 106 comprises a power cord 106A and a slot 106B. The slot 106B extends either partially or entirely through a portion of the housing 110. The slot 106B comprises a first slot portion 106C and a second slot portion 106D. The power cord 106A is operable to transfer power from a power source (not shown) to one or more portions of the air treatment device 100. The slot 106B is operable to at least partially secure, contain, support, and/or store at least a portion of the power cord 106A within at least a portion of the slot 106B. In operation, according to one embodiment, the power cord management system 106 is structured so that a user may wrap, bundle, bunch, and/or otherwise collect the power cord 106A and position at least a portion of the power cord 106A at least partially within the slot 106B. In one embodiment, the power cord 106A may be inserted into the slot 106B near the first slot portion 106C and then pushed, pulled, and/or otherwise moved towards the second slot portion 106D, and/or vice versa. The power cord management system 106 aids in protecting the power cord 106A from damage when the unit is not in use. The power cord management system 106 also complements the shape of the air treatment device 100 so as to effectively and neatly maintain and/or retain the power cord 106A without substantially visually impacting the aesthetic design of the air treatment device 100.

Further, it will be understood that the slot 106B may comprise any shape, any size, and/or may be positioned anywhere on and/or in the housing 110. For example, as shown in FIGS. 1B, 1E, and 1F, the slot 106B is positioned near a lower portion of the rear portion 116 and comprises an elongated shape and a generally rectangular cross-section. In addition, the slot 106B extends all of the way through the rear portion 116, such that the power cord 106A may be inserted into an opening adjacent the first slot portion 106C or an opening adjacent the second slot portion 106D. Also, the slot 106B extends generally straight through the rear portion 116 from the first slot portion 106C towards the second slot portion 106D. In addition, as shown in FIGS. 1B, 1E, and 1F, the slot 106B may extend in a direction generally parallel to the vertical reference plane VRP and/or in a direction generally perpendicular to the plane of symmetry POS. Further, it will be understood that, in some embodiments, one or more portions of the slot 106B may generally conform to one or more of the curvatures of the housing 110, including, for example, the first front curvature 113, the second front curvature 104, the first rear curvature 105, and/or the second rear curvature 118. Also, as shown, the slot 106B may be integral with, and/or formed from the same materials as, the rear portion 116.

However, it will be understood that the slot 106B may comprise different dimensions in other embodiments, including, for example, having a curved shape, a circular cross section, an orientation generally perpendicular to the vertical reference plane VRP, and/or the like. It will also be understood that, in some embodiments, the slot 106B may be structured to store all or nearly all of the power cord 106A entirely within the slot 106B. In other embodiments, the slot 106B may be at least partially defined by, located on and/or in, and/or positioned on and/or in some other portion of the housing 110 in addition to, or instead of, the rear portion 116. Still further, in some embodiments, the slot 106B may be distinct from the rear portion 116 and/or be formed from one or more materials other than, or in addition to, those used to form the rear portion 116 and/or other portions of the housing 110. Also, it will be understood that, in some embodiments, the slot 106B may not extend all of the way through the rear portion 116, i.e. the slot 106B may have only a single opening through which the power cord 106A may be inserted.

It will be understood that advantages, features, and operational aspects of the foregoing embodiment may be included in other housing configurations, examples of which are described hereinafter.

Referring now to FIGS. 2A-2C, a housing 210 for use with an air treatment device 200 is provided, in accordance with an embodiment of the present invention. The housing 210 comprises a front portion 211, a rear portion 216, and a bottom portion 219. The front portion 211 comprises a first front curvature 213, a second front curvature 204, and an air inlet 223 comprising a recessed portion 212. The recessed portion 212 comprises one or more connectors 214 and upper, lower, and opposed side edges 215A-215D. The rear portion 216 comprises an air outlet 217, a first rear curvature 205, a second rear curvature 218, a handle 208, and a bottom portion 219 comprising one or more bases 209. Though not shown, the housing 210 may also comprise one or more purification systems, as described herein. In addition, the housing 210 may also comprise a cowling 220 comprising a cowling curvature 222, and a control display 240 comprising one or more control display buttons 242. It will also be understood that, like the housing 110 of FIGS. 1A-1H, the housing 210 of this embodiment may also comprise a power cord for delivering power to the device, a power cord management system for storing a power cord associated with the device, and/or one or more fasteners for assembling the device.

As shown in FIG. 2B, the first front curvature 213 extends from the first point 213A positioned near a central region of the front portion 211 and continues upwardly and backwardly to the second point 213B positioned near a top perimeter of the front portion 211. As a source of reference only, FIG. 2B also depicts a vertical reference plane VRP, which may be defined at an exemplary forward-most point FMP on the front portion 211. In some embodiments, the first front curvature 213 curves away from the vertical reference plane VRP as the front portion 211 extends vertically upwards in a direction away from the bottom portion 219. Additionally, the first front curvature 213 may diverge away from the vertical reference plane VRP at a more pronounced or substantial rate than the rest of the front portion 211. Further, in some embodiments, the first front curvature 213 curves around a generally horizontal axis running through the housing 210, such that the first front curvature 213 may be characterized as convex as viewed from the exterior of the housing 210.

As shown in FIG. 2C, in some embodiments, the first front curvature 213 may also extend laterally outwardly and backwardly. The first front curvature 213 may be generally symmetrical about a plane of symmetry POS that runs through the middle of the housing 210 and that is generally perpendicular to the vertical reference plane VRP. The first front curvature 213 of one embodiment curves backwardly so as to diverge further away from the vertical reference plane VRP as the front portion 211 extends laterally away from the plane of symmetry POS. The first front curvature 213 presents an aesthetically pleasing shape and tends to make the housing 210 appear less imposing or obtrusive than it would appear without the first front curvature 213. The first front curvature 213 also provides a convenient-to-view location for at least a portion of the control display 240.

FIG. 2B also illustrates the first rear curvature 205 extending from a first point 205A positioned near a rear perimeter of the rear portion 216 and continuing upwardly and forwardly to the second point 205B near a top perimeter of the rear portion 216. In one embodiment, the first rear curvature 205 curves around a generally horizontal axis positioned outside of the housing 210, such that the first rear curvature 205 may be characterized as concave as viewed from the exterior of the housing 210. In another embodiment, the second point 213B of the front portion 211 and the second point 205B of the rear portion 216 may be positioned in the same location on the housing 210. Also in another embodiment, the first rear curvature 205 may also extend outwardly and forwardly (or flare), such that the first rear curvature 205 is generally symmetrical about the plane of symmetry POS that runs through the middle of the housing 210 and that is generally perpendicular to the bottom portion 219.

As shown in FIG. 2C, the second front curvature 204 extends from the first point 204A positioned near a central region of front portion 211 and continues laterally outwardly and backwardly (away from the vertical reference plane VRP) to the second point 204B positioned near an outer perimeter of the front portion 211. In many embodiments, including the one shown in FIG. 2C, the second front curvature 204 also extends from the first point 204A laterally outwardly and backwardly in a direction generally opposite from the second point 204B, such that the second front curvature 204 is generally symmetrical about the plane of symmetry POS that runs through the middle of the housing 210 and that is generally perpendicular to the bottom portion 219. In some embodiments, the second front curvature 204 curves around a generally vertical axis positioned in the housing 210, such that the second front curvature 204 may be characterized as convex as viewed from the exterior of the housing 210. As shown in FIG. 2B, the second front curvature 204 may also diverge or curve away from the vertical reference plane VRP as the front portion 211 extends vertically up in a direction away from the bottom portion 219.

Also shown in FIG. 2C is a second rear curvature 218, which extends from the first point 218A positioned near a rear perimeter of the rear portion 216 and continues forwardly and outwardly (or flares out) to the second point 218B positioned near a front edge of the rear portion 216. In some embodiments, including the one shown in FIG. 2C, another curvature 218' that generally mirrors the second rear curvature 218 is positioned on a generally opposite side of the housing 210, such that the housing 210 is generally symmetrical about the plane of symmetry POS that runs through the middle of the housing 210 and that is generally perpendicular to the bottom portion 219. In some embodiments, the second rear curvature 218 curves around a generally vertical axis positioned outside of the housing 210, such that the second rear curvature 218 may be characterized as concave as viewed from the exterior of the housing 210. Likewise, in some embodiments, the curvature 218' curves around a generally vertical axis positioned outside of the housing 210, such that the curvature 218' may be characterized as concave as viewed from the exterior of the housing 210.

As with the embodiment shown in FIGS. 2A-2C, it will be understood that at least a portion of the first rear curvature 205 and at least a portion of the second rear curvature 218 are positioned between the air outlet 217 and the air inlet 223. This helps deflect air from the air outlet 217 generally away from the air inlet 223 and tends to prevent or inhibit air flowing out of the air outlet 217 from immediately reentering the air inlet 223 of the housing 210. Further, it will be understood that, in some embodiments, the second rear curvature 218, like the first front curvature 213, the second front curvature 204, and/or the first rear curvature 205, may extend through one or more planes generally parallel to the bottom portion 219, through one or more planes generally perpendicular to the bottom portion 219, and/or through one or more planes in between. Accordingly, in some embodiments, including those shown in FIGS. 2A-2C, the first front curvature 213 may smoothly transition into the second front curvature 204 and/or vice versa, and/or the second rear curvature 218 may smoothly transition into the first rear curvature 205 and/or vice versa.

As shown in FIGS. 2A-2C, the housing 210 may have a cowling 220 comprising a cowling curvature 222. In some embodiments, when the cowling is releasably connected to the housing 210, the cowling curvature 222 curves around a generally vertical axis positioned in the housing 210, such that the cowling curvature 222 may be characterized as convex as viewed from the exterior of the housing 210. In another embodiment, the cowling curvature 222 curves around a generally horizontal axis positioned in the housing 210, such that the cowling curvature 222 may be characterized as convex as viewed from the exterior of the housing 210.

In some embodiments, the cowling curvature 222 may also be generally symmetrical about the plane of symmetry POS that runs through the middle of the housing 210. In still other embodiments, the cowling curvature 222 may also be generally symmetrical about other planes that are generally perpendicular to the bottom portion 219, generally parallel to the bottom portion 219, and/or about one or more planes in between. Further, as shown in FIGS. 2A-2C, the shape of the cowling curvature 222 may conform to the first front curvature 213 and/or the second front curvature 204, such that the cowling curvature 222 would smoothly transition into the first front curvature 213 and/or the second front curvature 204 if the opening to the air inlet 223 did not exist in the front portion 211 between the edges 215A-215D and the cowling 220. The cowling curvature 222 complements the other curvatures 213, 204, 205, and 218 to achieve a functional housing shape that also is aesthetically pleasing, helps the air treatment device 200 appear more graceful and sleek, and provides the air treatment device 200 with a slim and less obtrusive appearance from front to back and/or from side to side.

In many embodiments, the control display 240 includes an outer curvature that generally conforms to the shape of the first front curvature 213, thereby allowing the display 240 to be viewed from a position in front of and level with the display 240 and/or from a position in front of and above the display 240. In this configuration, at least some of the information and control buttons 242 on the control display 240 are also projected in these directions, making them easy for a user to view and access. It will be understood, however, that other embodiments may include control displays having a different type, size, shape, and/or in a different location than that of the housing 210 depicted in FIGS. 2A-2C.

Figure 2D:
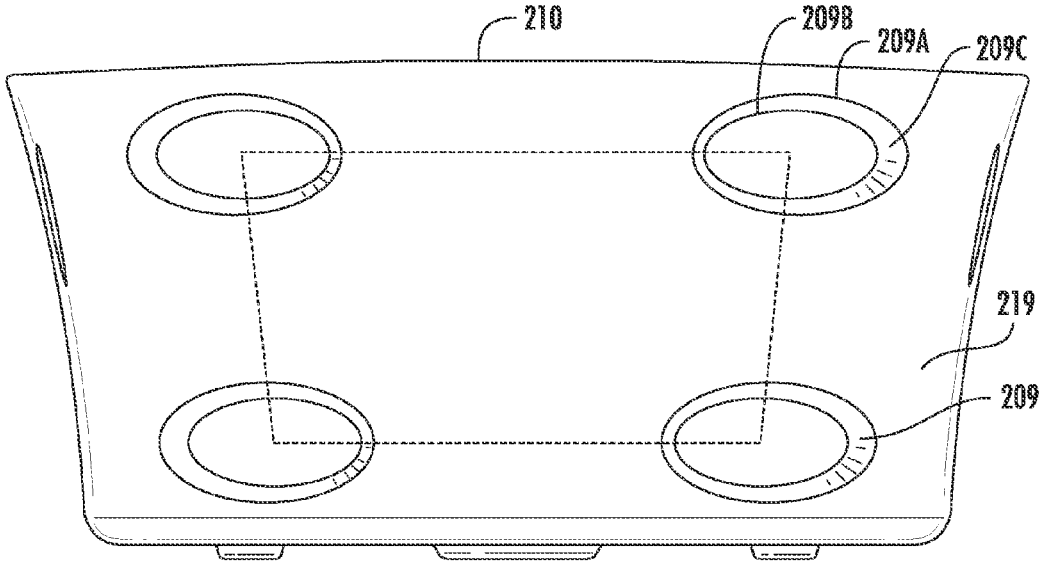

Referring now to FIG. 2D, a bottom view of the housing 210 is depicted. The bottom portion 219 of the housing 210 comprises one or more bases or feet 209. The base or bases 209 are structured and positioned to support the housing 210 on a support surface. In some embodiments, the base or bases 209 are structured for proper placement on a mesh support surface such as a mezzanine floor or a display rack where the support surface comprises spaced apart holes. In these instances, improper spacing or sizing of a base or bases on the housing 210 may cause one or more of the bases 209 to be located in a hole of the perforated or mesh support surface causing the housing 210 to not sit level on the support surface.

To address this issue, as depicted in FIG. 2D, in some embodiments, the housing 210 may include one or a plurality of bases 209 that are sized so as to have a dimension that is larger than a dimension of the holes in the support surface, such that the bases contact the edges of the holes in the support surface on which each base rests. Note, that many perforated or mesh support surfaces may have holes with multiple dimensions. For example, if the holes are square-shaped, the diagonal dimension of the hole will be larger than the side dimensions of the hole. As such, in some embodiments, the bases 209 are sized to be larger than the largest dimension of the holes of a given support surface to prevent the bases from inserting into the holes and making the housing unlevel. This allows the housing 210 to be placed in various orientations on the support surface while maintaining the housing 210 at a level orientation relative to the support surface. As also depicted in FIG. 2D, in one embodiment, the housing 210 may include one or more bases 209 that are of a non-square or non-circular shape, such as oval in shape. This also allows the housing to be placed into different orientations on the mesh support surface in a level position, as the bases 209 are shaped and sized to span a dimension of the holes so as to rest on the edges of the holes in the support surface.

As also depicted in FIG. 2D, in one embodiment, the housing 210 may include one or more bases 209 that are spaced apart in a non-square or non-rectangular configuration. For example, as demonstrated by the dotted line the bases may be spaced in a trapezoidal configuration. Other configurations such as triangular, rhombus, etc. are contemplated.

As also depicted in FIG. 2D, in one embodiment, the housing 210 may include one or more bases 209 that comprise a first end 209A for connection to the housing bottom portion 219 and a second opposed end 209B for contacting the support surface. The first and second opposed ends are spaced apart by one or more sidewalls 209C. The first end 209A has a larger lateral dimension than the second opposed end 209B, and the sidewalls 209C are tapered or drafted from the first end 209A to the second end 209B. In this manner, the first end 209A of each base can be placed further apart on the bottom portion 219 of the housing 210 and taper so as to create a smaller "foot print" for contacting the support surface.

An example of a mesh support surface might include strands (e.g., of steel or other material capable of reliably supporting the weight of an air treatment device) that are arranged in a grid pattern to provide substantially rectangular holes, The rectangular holes might be dimensioned, for example, approximately 0.8 inch to approximately one inch wide by approximately 3¾ inches long. The footprints of the ends 209B can be dimensioned so that, regardless of how the device is oriented in an upright position on the grid, the device remains level and the bases will not tend to fall into one of the holes in the grid.

As illustrated in FIGS. 2B and 2C, the housing 210 includes a handle 208 for lifting and carrying the unit. In some embodiments, the handle 208 is positioned vertically, horizontally, or both vertically and horizontally relative to the distribution of weight of the materials and components on and inside each device, so that when each device is lifted by its handle 208 the device has very little, or no, tendency to pivot about the handle. This tends to keep each device substantially upright when being lifted and can make movement of the devices from one location to another much less clumsy and much less likely to result in tipping or bumping of the devices. Following the general concept that an object will balance when its center of gravity (i.e., the position where all of its mass, on the average, resides) is directly over or under the point of support, the weight of the unit is generally balanced relative to the placement of the handle 208.

Referring now to FIGS. 3A-3C, a housing 310 according to another embodiment of the present invention is illustrated. The housing 310 comprises a front portion 311, rear portion 316, and a bottom portion 319. The front portion 311 comprises a first front curvature 313, a second front curvature 304, and an air inlet 323 comprising a recessed portion 312. The recessed portion 312 comprises one or more connectors 314 and upper, lower, and opposed side edges 315A-315D. The rear portion 316 comprises an air outlet 317, a first rear curvature 305, a second rear curvature 318, a handle 308, and a bottom portion 319 comprising one or more bases 309. In addition, the housing 310 may also comprise a cowling 320 comprising a cowling curvature 322, filters 330, and a control display 340 comprising one or more control display buttons 342. It will also be understood that, like the housing 110, the housing 310 of this embodiment may also comprise a power cord for delivering power to the device, a power cord management system for storing a power cord associated with the device, and/or one or more fasteners for assembling the device.

As shown in FIG. 3B, the first front curvature 313 extends from the first point 313A positioned near a central region of the front portion 311 and continues upwardly and backwardly to the second point 313B positioned near a top perimeter of the front portion 311. As a source of reference only, FIG. 3B also depicts a vertical reference plane VRP, which may be defined at an exemplary forward-most point FMP on the front portion 311. In some embodiments, the first front curvature 313 curves away from the vertical reference plane VRP as the front portion 311 extends vertically upwards in a direction away from the bottom portion 319. In other embodiments, the first front curvature 313 diverges away from the vertical reference plane VRP at a more pronounced or substantial rate than the rest of the front portion 311. Further, in some embodiments, the first front curvature 313 curves around a generally horizontal axis running through the housing 310, such that the first front curvature 313 may be characterized as convex as viewed from the exterior of the housing 310.

As shown in FIG. 3C, in some embodiments, the first front curvature 313 may also extend laterally outwardly and backwardly. The first front curvature 313 may be generally symmetrical about a plane of symmetry POS that runs through the middle of the housing 310 and that is generally perpendicular to the vertical reference plane VRP. The first front curvature 313 of one embodiment curves backwardly so as to diverge further away from the vertical reference plane VRP as the front portion 311 extends laterally away from the plane of symmetry POS. The first front curvature 313 presents an aesthetically pleasing shape and tends to make the housing 310 appear less imposing or obtrusive than it would appear without the first front curvature 313. The first front curvature 313 also provides a convenient-to-view and convenient-to-access location for at least a portion of the control display 340.

FIG. 3B also illustrates the first rear curvature 305 extending from a first point 305A positioned near a rear perimeter of the rear portion 316 and continuing upwardly and forwardly to the second point 305B near a top perimeter of the rear portion 316. In one embodiment, the first rear curvature 305 curves around a generally horizontal axis positioned outside of the housing 310, such that the first rear curvature 305 may be characterized as concave as viewed from the exterior of the housing 310. In another embodiment, the second point 313B of the front portion 311 and the second point 305B of the rear portion 316 may be positioned in the same location on the housing 310. Also in another embodiment, the first rear curvature 305 may also extend outwardly and forwardly (or flare), such that the first rear curvature 305 is generally symmetrical about the plane of symmetry POS that runs through the middle of the housing 310 and that is generally perpendicular to the bottom portion 319.

As shown in FIG. 3C, the second front curvature 304 extends from the first point 304A positioned near a central region of front portion 311 and continues laterally outwardly and backwardly (away from the vertical reference plane VRP) to the second point 304B positioned near an outer perimeter of the front portion 311. In many embodiments, including the one shown in FIG. 3C, the second front curvature 304 also extends from the first point 304A laterally outwardly and backwardly in a direction generally opposite from the second point 304B, such that the second front curvature 304 is generally symmetrical about the plane of symmetry POS that runs through the middle of the housing 310 and that is generally perpendicular to the bottom portion 319. In some embodiments, the second front curvature 304 curves around a generally vertical axis positioned in the housing 310, such that the second front curvature 304 may be characterized as convex as viewed from the exterior of the housing 310. As shown in FIG. 3B, the second front curvature 304 may also diverge or curve away from the vertical reference plane VRP as the front portion 311 extends vertically up in a direction away from the bottom portion 319.

Also shown in FIG. 3C is a second rear curvature 318, which extends from the first point 318A positioned near a rear perimeter of the rear portion 316 and continues forwardly and outwardly (or flares out) to the second point 318B positioned near a front edge of the rear portion 316. In some embodiments, including the one shown in FIG. 3C, another curvature 318' that generally mirrors the second rear curvature 318 is positioned on a generally opposite side of the housing 310, such that the housing 310 is generally symmetrical about the plane of symmetry POS that runs through the middle of the housing 310 and that is generally perpendicular to the bottom portion 319. In some embodiments, the second rear curvature 318 curves around a generally vertical axis positioned outside of the housing 310, such that the second rear curvature 318 may be characterized as concave as viewed from the exterior of the housing 310. Likewise, in some embodiments, the curvature 318' curves around a generally vertical axis positioned outside of the housing 310, such that the curvature 318' may be characterized as concave as viewed from the exterior of the housing 310.

As with some of the other embodiments described herein, it will be understood that at least a portion of the first rear curvature 305 and at least a portion of the second rear curvature 318 are positioned between the air outlet 317 and the air inlet 323. This helps deflect air from the air outlet 317 generally away from the air inlet 323 and tends to prevent or inhibit air flowing out of the air outlet 317 from immediately reentering the air inlet 323 of the housing 310. Further, it will be understood that, in some embodiments, the second rear curvature 318, like the first front curvature 313, the second front curvature 304, and/or the first rear curvature 305, may extend through one or more planes generally parallel to the bottom portion 319, through one or more planes generally perpendicular to the bottom portion 319, and/or through one or more planes in between. Accordingly, in some embodiments, including those shown in FIGS. 3A-3C, the first front curvature 313 may smoothly transition into the second curvature 304 and/or vice versa, and/or the second rear curvature 318 may smoothly transition into the first rear curvature 305 and/or vice versa.

As shown in FIGS. 3A-3C, the housing 310 may have a cowling 320 comprising a cowling curvature 322. In some embodiments, when the cowling is releasably connected to the housing 310, the cowling curvature 322 curves around a generally vertical axis positioned in the housing 310, such that the cowling curvature 322 may be characterized as convex as viewed from the exterior of the housing 310. In another embodiment, the cowling curvature 322 curves around a generally horizontal axis positioned in the housing 310, such that the cowling curvature 322 may be characterized as convex as viewed from the exterior of the housing 310.

In some embodiments, the cowling curvature 322 may also be generally symmetrical about the plane of symmetry POS that runs through the middle of the housing 310. In still other embodiments, the cowling curvature 322 may also be generally symmetrical about other planes that are generally perpendicular to the bottom portion 319, generally parallel to the bottom portion 319, and/or about one or more planes in between. Further, as shown in FIGS. 3A-3C, the shape of the cowling curvature 322 may conform to the first front curvature 313 and/or the second front curvature 304, such that the cowling curvature 322 would smoothly transition into the first front curvature 313 and/or the second front curvature 304 if the opening to the air inlet 323 did not exist in the front portion 311 between the edges 315A-315D and the cowling 320. The cowling curvature 322 complements the other curvatures 313, 304, 305, and 318 to achieve a functional housing shape that also is aesthetically pleasing, helps the air treatment device 300 appear more graceful and sleek, and provides the air treatment device 300 with a slim and less obtrusive appearance from front to back and/or from side to side.

The control display 340 may include an outer curvature that generally conforms to the shape of the first front curvature 313, thereby allowing the display 340 to be viewed from a position in front of and level with the display 340 and at a position in front of and above the display 340. In this configuration, at least some of the information and control buttons 342 on the control display 340 are also projected in these directions, making them easy for a user to view and access. It will be understood, however, that other embodiments may include control displays having a different type, size, shape, and/or in a different location than that of the housing 310 depicted in FIGS. 3A-3C.

As illustrated in FIGS. 3B and 3C, the housing 310 includes a handle 308 for lifting and carrying the unit. In some embodiments, the handle 308 is positioned vertically, horizontally, or both vertically and horizontally relative to the center of gravity of the unit so that when the unit is lifted, the unit does not swing or rotate significantly either front and rearwardly or side to side. Following the general concept that an object will balance when its center of gravity (i.e., the position where all of its mass, on the average, resides) is directly over or under the point of support, the weight of the unit is generally balanced relative to the placement of the handle 308.

Referring now to FIGS. 4A-4D, a housing 410 according to another embodiment of the present invention is illustrated. The housing 410 comprises a front portion 411, rear portion 416, and the bottom portion 419. The front portion 411 comprises a first front curvature 413, second front curvature 404, and an air inlet 423 comprising a recessed portion 412. The recessed portion 412 comprises one or more connectors 414 and upper, lower, and opposed side edges 415A-415D. The rear portion 416 comprises an air outlet 417, a first rear curvature 405, a second rear curvature 418, a handle 408, a remote control holder 403, and a bottom portion 419 that comprises one or more bases 409. Though not shown, the housing 410 may also comprise one or more purification systems in some embodiments. In addition, the housing 410 may also comprise a cowling 420 comprising a cowling curvature 422, and a control display 440 comprising one or more control display buttons 442. It will also be understood that, like the housing 110, the housing 410 of this embodiment may also comprise a power cord for delivering power to the device, a power cord management system for storing a power cord associated with the device, and/or one or more fasteners for assembling the device.

As shown in FIG. 4B, the first front curvature 413 extends from the first point 413A positioned near a central region of the front portion 411 and continues upwardly and backwardly to the second point 413B positioned near a top perimeter of the front portion 411. As a source of reference only, FIG. 4B also depicts a vertical reference plane VRP, which may be defined at an exemplary forward-most point FMP on the front portion 411. In some embodiments, the first front curvature 413 curves away from the vertical reference plane VRP as the front portion 411 extends vertically upwards in a direction away from the bottom portion 419. In other embodiments, the first front curvature 413 diverges away from the vertical reference plane VRP at a more pronounced or substantial rate than the rest of the front portion 411. Further, in some embodiments, the first front curvature 413 curves around a generally horizontal axis running through the housing 410, such that the first front curvature 413 may be characterized as convex as viewed from the exterior of the housing 410.

As shown in FIG. 4C, in some embodiments, the first front curvature 413 may also extend laterally outwardly and backwardly. The first front curvature 413 may be generally symmetrical about a plane of symmetry POS that runs through the middle of the housing 410 and that is generally perpendicular to the vertical reference plane VRP. The first front curvature 413 of one embodiment curves backwardly so as to diverge further away from the vertical reference plane VRP as the front portion 411 extends laterally away from the plane of symmetry POS. The first front curvature 413 presents an aesthetically pleasing shape and tends to make the housing 410 appear less imposing or obtrusive than it would appear without the first front curvature 413. The first front curvature 413 also provides a convenient-to-view and convenient-to-access location for at least a portion of the control display 440.

FIG. 4B also illustrates the first rear curvature 405 extending from a first point 405A positioned near a rear perimeter of the rear portion 416 and continuing upwardly and forwardly to the second point 405B near a top perimeter of the rear portion 416. In one embodiment, the first rear curvature 405 curves around a generally horizontal axis positioned outside of the housing 410, such that the first rear curvature 405 may be characterized as concave as viewed from the exterior of the housing 410. In another embodiment, the second point 413B of the front portion 411 and the second point 405B of the rear portion 416 may be positioned in the same location on the housing 410. Also in another embodiment, the first rear curvature 405 may also extend outwardly and forwardly (or flare), such that the first rear curvature 405 is generally symmetrical about the plane of symmetry POS that runs through the middle of the housing 410 and that is generally perpendicular to the bottom portion 419.

As shown in FIG. 4C, the second front curvature 404 extends from the first point 404A positioned near a central region of front portion 411 and continues laterally outwardly and backwardly (away from the vertical reference plane VRP) to the second point 404B positioned near an outer perimeter of the front portion 411. In many embodiments, including the one shown in FIG. 4C, the second front curvature 404 also extends from the first point 404A laterally outwardly and backwardly in a direction generally opposite from the second point 404B, such that the second front curvature 404 is generally symmetrical about the plane of symmetry POS that runs through the middle of the housing 410 and that is generally perpendicular to the bottom portion 419. In some embodiments, the second front curvature 404 curves around a generally vertical axis positioned in the housing 410, such that the second front curvature 404 may be characterized as convex as viewed from the exterior of the housing 410. As shown in FIG. 4B, the second front curvature 404 may also diverge or curve away from the vertical reference plane VRP as the front portion 411 extends vertically up in a direction away from the bottom portion 419.

Also shown in FIG. 4C is a second rear curvature 418, which extends from the first point 418A positioned near a rear perimeter of the rear portion 416 and continues forwardly and outwardly (or flares out) to the second point 418B positioned near a front edge of the rear portion 416. In some embodiments, including the one shown in FIG. 4C, another curvature 418' that generally mirrors the second rear curvature 418 is positioned on a generally opposite side of the housing 410, such that the housing 410 is generally symmetrical about the plane of symmetry POS that runs through the middle of the housing 410 and that is generally perpendicular to the bottom portion 419. In some embodiments, the second rear curvature 418 curves around a generally vertical axis positioned outside of the housing 410, such that the second rear curvature 418 may be characterized as concave as viewed from the exterior of the housing 410. Likewise, in some embodiments, the curvature 418' curves around a generally vertical axis positioned outside of the housing 410, such that the curvature 418' may be characterized as concave as viewed from the exterior of the housing 410.

As with some of the other embodiments described herein, it will be understood that at least a portion of the first rear curvature 405 and at least a portion of the second rear curvature 418 are positioned between the air outlet 417 and the air inlet 423. This helps deflect air from the air outlet 417 generally away from the air inlet 423 and tends to prevent or inhibit air flowing out of the air outlet 417 from immediately reentering the air inlet 423 of the housing 410. Further, it will be understood that, in some embodiments, the second rear curvature 418, like the first front curvature 413, the second front curvature 404, and/or the first rear curvature 405, may extend through one or more planes generally parallel to the bottom portion 419, through one or more planes generally perpendicular to the bottom portion 419, and/or through one or more planes in between. Accordingly, in some embodiments, including those shown in FIGS. 4A-4C, the first front curvature 413 may smoothly transition into the second front curvature 404 and/or vice versa, and/or the second rear curvature 418 may smoothly transition into the first rear curvature 405 and/or vice versa.

As shown in FIGS. 4A-4C, the housing 410 may have a cowling 420 comprising a cowling curvature 422. In some embodiments, when the cowling is releasably connected to the housing 410, the cowling curvature 422 curves around a generally vertical axis positioned in the housing 410, such that the cowling curvature 422 may be characterized as convex as viewed from the exterior of the housing 410. In another embodiment, the cowling curvature 422 curves around a generally horizontal axis positioned in the housing 410, such that the cowling curvature 422 may be characterized as convex as viewed from the exterior of the housing 410.

In some embodiments, the cowling curvature 422 may also be generally symmetrical about the plane of symmetry POS that runs through the middle of the housing 410. In still other embodiments, the cowling curvature 422 may also be generally symmetrical about other planes that are generally perpendicular to the bottom portion 419, generally parallel to the bottom portion 419, and/or about one or more planes in between. Further, as shown in FIGS. 4A-4C, the shape of the cowling curvature 422 may conform to the first front curvature 413 and/or the second front curvature 404, such that the cowling curvature 422 would smoothly transition into the second front curvature 404 if the generally U-shaped opening to the air inlet 423 did not exist in the front portion 411 between the edges 415B-415D and the cowling 420. The cowling curvature 422 complements the other curvatures 413, 404, 405, and 418 to achieve a functional housing shape that also is aesthetically pleasing, helps the air treatment device 400 appear more graceful and sleek, and provides the air treatment device 400 with a slim and less obtrusive appearance from front to back and/or from side to side.

The control display 440 may include an outer curvature that generally conforms to the shape of the first front curvature 413, thereby allowing the display 440 to be viewed from a position in front of and level with the display 440 and at a position in front of and above the display 440. In this configuration, at least some of the information and control buttons 442 on the control display 440 are also projected in these directions, making them easy for a user to view and access. It will be understood, however, that other embodiments may include control displays having a different type, size, shape, and/or in a different location than that of the housing 410 depicted in FIGS. 4A-4C.

In addition, FIGS. 4C and 4D illustrate a remote control holder 403 positioned below the handle 408 on the rear portion 416 of the housing 410, although in other embodiments, the remote control holder 403 may be positioned anywhere on the housing 410. As shown, the remote control holder 403 is a cavity in the rear portion 416 having a size and shape configured to hold at least one remote control (not shown) for remotely operating at least one function and/or aspect of the air treatment device 400. However, it will be understood that other embodiments of the present invention may include different sizes, shapes, and/or types of remote control holders, including, for example, a fastener, clip, slot, magnet, hook, and/or anything else that may be configured to hold and/or releasably secure a remote control at least partially within, to, and/or adjacent to the housing.

In addition to the other features mentioned herein, the air treatment device 400 also comprises one or more sensors positioned, for example, in the control display 440, for communicating with the remote control. In some embodiments, the remote control communicates with the sensors on the air treatment device 400 via one or more infrared (IR) signals, but other mediums of wireless communication may be used instead, such as, for example, one or more optical and/or radio signals. In addition to the air treatment device 400, it will be understood that the other embodiments described herein, including air treatment devices 100, 200, 300, and 500, may also include one or more remote control holders and/or one or more sensors for communicating with one or more remote controls.

Further, as shown in FIGS. 4A-4C, the cowling 420 is positioned relative to the recessed portion 412, such that together the cowling 420 and the edges 415B-415D of the recessed portion 412 define a generally U-shaped opening to the air inlet 423 for air to enter the housing 410. The shape of this opening to the air inlet 423 is different from some of the other embodiments described herein because a top portion of the cowling 420 smoothly transitions into the front portion 411 to provide little, if any, distance between the top edge 415A and the cowling 420. However, it will be understood that, in other embodiments, a generally U-shaped opening to the air inlet 423 could alternatively be created by abutting the cowling 420 with one of the bottom or side edges 415B-415D of the recessed portion 412.

In some embodiments, including the one shown in FIGS. 4A-4C, the cowling curvature 422 smoothly transitions into the first front curvature 413. Also, in some embodiments and shown in FIGS. 4A-4C, the recessed portion 412 extends past a top portion of the cowling 420 and continues towards a top perimeter of the front portion 411. Additionally, the recessed portion 412 may conform to the first front curvature 413 and/or may transition or converge into the front portion 411 near a top perimeter of the front portion 411, as shown in FIGS. 4A-4C.

Referring again to FIG. 4D, the housing 410 also comprises a power cord 406A and a power cord management system 406, in accordance with an embodiment of the present invention. As shown, the power cord management system 406 comprises a recessed portion 406B located in the housing 410. The recessed portion 406B further comprises a first knob 406C and a second knob 406D. As shown, the first knob 406C and the second knob 406D are positioned within the recessed portion 406B, are spaced apart from one another along an axis that is generally parallel to the bottom portion 419, and extend outwardly from the recessed portion in a direction generally parallel to the plane of symmetry POS.

According to one embodiment, the power cord 406A is operable to transfer power from a power source (not shown) to one or more portions of the air treatment device 400. In addition, the recessed portion 406B, first knob 406C, and second knob 406D are operable to at least partially secure, contain, support, and/or store at least a portion of the power cord 406A within at least a portion of the recessed portion 406B. In operation, according to one embodiment, the power cord management system 406 is structured so that a user may wrap and/or otherwise position the power cord 406A on and/or around one or both of the first knob 406C and/or the second knob 406D, such that at least a portion of the power cord 406A is at least partially stored within the recessed portion 406B. In some embodiments, the knobs may each comprise protuberances at distal ends thereof to better secure the power cord 406A around the knobs and within the recessed portion 406B. Like the embodiments of the power cord management system 106 discussed in connection with FIGS. 1B, 1E, and 1F, the power cord management system 406 aids in protecting the power cord 406A from damage when the unit is not in use. The power cord management system 406 also complements the shape of the air treatment device 400 so as effectively maintain the power cord without substantially visually impacting the aesthetic design of the air treatment device 400.

Further, it will be understood that the recessed portion 406B may comprise any shape, any size, and/or may be positioned anywhere on and/or in the housing 410. For example, as shown in FIG. 4D, the recessed portion 406B is positioned near a lower portion of the rear portion 416. In addition, the recessed portion 406B comprises a bottom portion having a generally rectangular shape and an upper portion having a generally parabolic shape that extends upwardly and laterally outwardly. Further, as shown in FIG. 4D, the recessed portion 406B may extend in a direction generally parallel to the vertical reference plane VRP and/or in a direction generally perpendicular to the plane of symmetry POS. Still further, it will be understood that, in some embodiments, one or more portions of the recessed portion 406B may generally conform to one or more of the curvatures of the housing 410, including, for example, the first front curvature 413, the second front curvature 404, the first rear curvature 405, and/or the second rear curvature 418. Also as shown, the recessed portion 406B may be integral with, and/or formed from the same materials as, the rear portion 416. It will also be understood that the recessed portion 406B may be recessed into the housing 410 by any depth, and in one embodiment, the recessed portion 406B is recessed into the rear portion 416 at a depth suitable to store all or nearly all of the power cord 406A entirely within the recessed portion 406B.

However, it will be understood that the recessed portion 406B may comprise different dimensions in other embodiments, including, for example, having a generally square shape, an orientation generally perpendicular to the vertical reference plane VRP, a depth unsuitable for storing the power cord 406A entirely within the recessed portion 406B, and/or the like. In other embodiments, the recessed portion 406B may be at least partially defined by, located on and/or in, and/or positioned on and/or in some other portion of the housing 410 in addition to, or instead of, the rear portion 416.

Still further, in some embodiments, the recessed portion 406B may be distinct from the rear portion 416 and/or be formed from one or more materials other than, or in addition to, those used to form the rear portion 416 and/or other portions of the housing 410. Also, in other embodiments, the recessed portion 406B may comprise more or fewer knobs, comprise knobs that are positioned in the recessed portion 406B in a different configuration, and/or comprise knobs of different shapes and/or sizes. Additionally, in some embodiments, the recessed portion 406B may include hooks, handles, and/or some other structure on and/or around which to position the power cord 406A in addition to, or instead of, one or more knobs.

As illustrated in FIGS. 4C and 4D, the housing 410 includes a handle 408 for lifting and carrying the unit. In some embodiments, the handle 408 is positioned vertically, horizontally, or both vertically and horizontally relative to the center of gravity of the unit so that when the unit is lifted, the unit does not swing or rotate significantly either front and rearwardly or side to side. Following the general concept that an object will balance when its center of gravity (i.e., the position where all of its mass, on the average, resides) is directly over or under the point of support, the weight of the unit is generally balanced relative to the placement of the handle 408.

Referring now to FIGS. 5A-5C, an embodiment of a housing 510 according to one embodiment of the present invention is illustrated. The housing 510 has a front portion 511, rear portion 516, and a bottom portion 519. The front portion 511 comprises a first front curvature 513, second front curvature 504, and an air inlet 523 comprising a recessed portion 512. The recessed portion 512 comprises one or more connectors 514 and upper, lower, and opposed side edges 515A-515D. The rear portion 516 comprises an air outlet 517, a first rear curvature 505, a second rear curvature 518 comprising first and second curvature regions 518E-518F, a handle 508, a remote control holder 503, and a bottom portion 519 comprising one or more bases 509. Though not shown, the housing 510 may also comprise one or more purification systems in some embodiments. In addition, the housing 510 may also comprise a cowling 520 comprising a cowling curvature 522, and a control display 540 comprising one or more control display buttons 542. It will also be understood that, like the housing 110, the housing 510 of this embodiment may also comprise a power cord for delivering power to the device, a power cord management system for storing a power cord associated with the device, and/or one or more fasteners for assembling the device.

As shown in FIG. 5B, the first front curvature 513 extends from the first point 513A positioned near a central region of the front portion 511 and continues upwardly and backwardly to the second point 513B positioned near a top perimeter of the front portion 511. As a source of reference only, FIG. 5B also depicts a vertical reference plane VRP, which may be defined at an exemplary forward-most point FMP on the front portion 511. In some embodiments, the first front curvature 513 curves away from the vertical reference plane VRP as the front portion 511 extends vertically upwards in a direction away from the bottom portion 519. In other embodiments, the first front curvature 513 diverges away from the vertical reference plane VRP at a more pronounced or substantial rate than the rest of the front portion 511. In some embodiments, the first front curvature 513 curves around a generally horizontal axis running through the housing 510, such that the first front curvature 513 may be characterized as convex as viewed from the exterior of the housing 510.

As shown in FIG. 5C, in some embodiments, the first front curvature 513 may also extend laterally outwardly and backwardly. The first front curvature 513 may be generally symmetrical about a plane of symmetry POS that runs through the middle of the housing 510 and that is generally perpendicular to the vertical reference plane VRP. The first front curvature 513 of one embodiment curves backwardly so as to diverge further away from the vertical reference plane VRP as the front portion 511 extends laterally away from the plane of symmetry POS. The first front curvature 513 presents an aesthetically pleasing shape and tends to make the housing 510 appear less imposing or obtrusive than it would appear without the first front curvature 513. The first front curvature 513 also provides a convenient-to-view and convenient-to-access location for at least a portion of the control display 540.

FIG. 5B also illustrates the first rear curvature 505 extending from a first point 505A positioned near a rear perimeter of the rear portion 516 and continuing upwardly and forwardly to the second point 505B near a top perimeter of the rear portion 516. In one embodiment, the first rear curvature 505 curves around a generally horizontal axis positioned outside of the housing 510, such that the first rear curvature 505 may be characterized as concave as viewed from the exterior of the housing 510. In another embodiment, the second point 513B of the front portion 511 and the second point 505B of the rear portion 516 may be positioned in the same location on the housing 510. Also in another embodiment, the first rear curvature 505 may also extend outwardly and forwardly (or flare), such that the first rear curvature 505 is generally symmetrical about the plane of symmetry POS that runs through the middle of the housing 510 and that is generally perpendicular to the bottom portion 519.

As shown in FIG. 5C, the second front curvature 504 extends from the first point 504A positioned near a central region of front portion 511 and continues laterally outwardly and backwardly (away from the vertical reference plane VRP) to the second point 504B positioned near an outer perimeter of the front portion 511. In many embodiments, including the one shown in FIG. 5C, the second front curvature 504 also extends from the first point 504A laterally outwardly and backwardly in a direction generally opposite from the second point 504B, such that the second front curvature 504 is generally symmetrical about the plane of symmetry POS that runs through the middle of the housing 510 and that is generally perpendicular to the bottom portion 519. In some embodiments, the second front curvature 504 curves around a generally vertical axis positioned in the housing 510, such that the second front curvature 504 may be characterized as convex as viewed from the exterior of the housing 510. As shown in FIG. 5B, the second front curvature 504 may also diverge or curve away from the vertical reference plane VRP as the front portion 511 extends vertically up in a direction away from the bottom portion 519.

Also shown in FIG. 5C is the second rear curvature 518, which is positioned on the rear portion 516 and, when viewed from above the housing 510, generally resembles a portion of a bell-shaped curve. In this embodiment, the second rear curvature 518 extends (or flares) laterally outwardly as it extends towards the front portion 511. In this particular embodiment, the second rear curvature 518 includes two curvature regions 518E and 518F, but in other embodiments, the second rear curvature 518 may include more or fewer curvature regions. As shown, these two curvature regions 518E and 518F may be arranged on one side of the plane of symmetry POS.

In some embodiments, as shown, another curvature 518' that mirrors each region 518E and 518F may be arranged on the opposite side of the plane of symmetry POS on the housing 510. Together, the curvatures 518 and 518' define exterior side walls of the rear portion 516, and in some embodiments, such as the one shown, the curvatures 518 and 518' may extend rearward from the front portion 511 and converge near a rear perimeter of the rear portion 516. Further, as shown in FIG. 5C, the curvatures 518 and 518' generally resemble a portion of a bell-shaped curve when viewed from above the housing 510.

The first curvature region 518E of the second rear curvature 518 extends from a first point 518A positioned at or near, depending on the embodiment, a junction of the front portion 511 and rear portion 516 and continues rearward to a second point 518B positioned on the perimeter of rear portion 516. In some embodiments, the first curvature region 518E curves around a generally vertical axis positioned outside of the housing 510, such that the first curvature region 518E may be characterized as concave as viewed from the exterior of the housing 510. The second curvature region 518F of the second rear curvature 518 extends from a third point 518C on the perimeter of the rear portion 516 and continues rearward to a fourth point 518D positioned near a further most rear point on the rear portion 516. In some embodiments, the second curvature region 518F curves around a generally vertical axis positioned inside of the housing 510, such that the second curvature region 518F may be characterized as convex as viewed from the exterior of the housing 510.

In some embodiments, the second point 518B and the third point 518C may be positioned at the same location on the perimeter of the rear portion 516. Further, as illustrated in FIG. 5B, the first point 518A may be located at the junction of the front and rear portions 511, 516 or there may be a fillet portion 518G between the first point 518A and the front portion 511.

As with some of the other embodiments described herein, it will be understood that at least a portion of the first rear curvature 505 and at least a portion of the second rear curvature 518 are positioned between the air outlet 517 and the air inlet 523. This helps deflect air from the air outlet 517 generally away from the air inlet 523 and tends to prevent or inhibit air flowing out of the air outlet 517 from immediately reentering the air inlet 523 of the housing 510. For example, in some embodiments, such as that depicted in FIGS. 5A-5C, the air outlet 517 is located on the second curvature region 518F defined between points 518C, 518D of the second rear curvature 518. Additionally, the first curvature region 518E of the second rear curvature 518 is located between the air outlet 517 and the air inlet 523 on the front portion 511. Accordingly, either the curvature of the front curvature region 518E, the curvature of the second curvature region 518F, or a combination of the two curvature regions 518E, 518F inhibit air escaping the air outlet 517 from immediately reentering the housing 510 through the air inlet 523.

In some embodiments, including the one shown in FIGS. 5A-5C, the first and second curvature regions 518E, 518F of the second rear curvature 518 are positioned on a first side of the rear portion 516 of the housing 510. In other embodiments, the opposed second side of the rear portion 516 has another curvature 518' that generally mirrors the second rear curvature 518, thereby creating a rear portion 516 having a generally bell-shaped curvature (when viewed from above) that is generally symmetrical about the plane of symmetry POS that runs through the middle of the housing 510 and that is generally perpendicular to the bottom portion 519.

Further, it will be understood that, in some embodiments, the second rear curvature 518, like the first front curvature 513, second front curvature 504, and/or first rear curvature 505, may extend through one or more planes generally parallel to the bottom portion 519, through one or more planes generally perpendicular to the bottom portion 519, and/or through one or more planes in between. Accordingly, in some embodiments, including those shown in FIGS. 5A-5C, the first front curvature 513 may smoothly transition into the second front curvature 504 and/or vice versa, and/or the second rear curvature 518 may smoothly transition into the first rear curvature 505 and/or vice versa.

As shown in FIGS. 5A-5C, the housing 510 may have a cowling 520 comprising a cowling curvature 522. In some embodiments, when the cowling is releasably connected to the housing 510, the cowling curvature 522 curves around a generally vertical axis positioned in the housing 510, such that the cowling curvature 522 may be characterized as convex as viewed from the exterior of the housing 510. In another embodiment, the cowling curvature 522 curves around a generally horizontal axis positioned in the housing 510, such that the cowling curvature 522 may be characterized as convex as viewed from the exterior of the housing 510.

In some embodiments, the cowling curvature 522 may also be generally symmetrical about the plane of symmetry POS that runs through the middle of the housing 510. In still other embodiments, the cowling curvature 522 may also be generally symmetrical about other planes that are generally perpendicular to the bottom portion 519, generally parallel to the bottom portion 519, and/or about one or more planes in between. Further, as shown in FIGS. 5A-5C, the shape of the cowling curvature 522 may conform to the first front curvature 513 and/or the second front curvature 504, such that the cowling curvature 522 would smoothly transition into the second front curvature 504 if the generally U-shaped opening to the air inlet 523 did not exist in the front portion 511 between the edges 515B-515D and the cowling 520. The cowling curvature 522 complements the other curvatures 513, 504, 505, and 518 to achieve a functional housing shape that also is aesthetically pleasing, helps the air treatment device 500 appear more graceful and sleek, and provides the air treatment device 500 with a slim and less obtrusive appearance from front to back and/or from side to side.

The control display 540 may include an outer curvature that generally conforms to the shape of the first front curvature 513, thereby allowing the display 540 to be viewed from a position in front of and level with the display 540 and at a position in front of and above the display 540. In this configuration, at least some of the information and control buttons 542 on the control display 540 are also projected in these directions, making them easy for a user to view and access. It will be understood, however, that other embodiments may include control displays having a different type, size, shape, and/or in a different location than that of the housing 510 depicted in FIGS. 5A-5C.

In addition, similar to the housing 410 of FIGS. 4A-4C, the housing 510 may include a remote control holder 503 positioned below the handle 508 on the rear portion 516 of the housing 510, although it will be understood that other embodiments may include a remote control holder of a different size, shape, and/or positioned in a different location on the housing 510.

Also similar to the embodiment of FIGS. 4A-4C, the air treatment device 500 comprises one or more sensors positioned, for example, in the control display 540, for communicating with a remote control (not shown). In some embodiments, the remote control communicates with the sensors on the air treatment device 500 via one or more infrared (IR) signals, but other mediums of wireless communication may be used instead, such as, for example, one or more optical and/or radio signals. In addition to the air treatment device 500, it will be understood that the other embodiments described herein may also include one or more remote control holders and/or one or more sensors for communicating with one or more remote controls.

Further, as shown in FIGS. 5A-5C, the cowling 520 is positioned relative to the recessed portion 512, such that together the cowling 520 and the edges 515B-515D of the recessed portion 512 define a generally U-shaped opening to the air inlet 523 for air to enter the housing 510. The shape of this opening to the air inlet 523 is different from some of the other embodiments described herein because a top portion of the cowling 520 smoothly transitions into the front portion 511 to provide little, if any, distance between the top edge 515A and the cowling 520. However, it will be understood that, in other embodiments, a generally U-shaped opening to the air inlet 523 could alternatively be created by abutting the cowling 520 with one of the bottom or side edges 515B-515D of the recessed portion 512.

In some embodiments, including the one shown in FIGS. 5A-5C, the cowling curvature 522 smoothly transitions into the first front curvature 513. Also, in some embodiments and shown in FIGS. 5A-5C, the recessed portion 512 extends past a top portion of the cowling 520 and continues towards a top perimeter of the front portion 511. Additionally, the recessed portion 512 may conform to the first front curvature 513 and/or may transition or converge into the front portion 511 near a top perimeter of the front portion 511, as shown in FIGS. 5A-5C.

As illustrated in FIGS. 5B and 5C, the housing 510 includes a handle 508 for lifting and carrying the unit. In some embodiments, the handle 508 is positioned vertically, horizontally, or both vertically and horizontally relative to the center of gravity of the unit so that when the unit is lifted, the unit does not swing or rotate significantly either front and rearwardly or side to side. Following the general concept that an object will balance when its center of gravity (i.e., the position where all of its mass, on the average, resides) is directly over or under the point of support, the weight of the unit is generally balanced relative to the placement of the handle 508.

It will be understood that the recessed portions 112, 212, 312, 412 and 512 may be provided with a curved or rounded wall configuration (or alternatively an internal corner) to serve, for example, as an air scoop for intake air. The curving of the recessed portions 112, 212, 312, 412 and 512 may be provided as a quarter turn (or approximately quarter-turn) so that air flowing into the air treatment devices 100, 200, 300, 400, 500 is directed inwardly towards the back (or interior) surface of the cowlings 120, 220, 320, 420 or 520. This exemplary arrangement allows the air treatment devices 100, 200, 300, 400, 500 to be equipped with large openings to the air inlets 123, 223, 323, 423 or 523 without sacrificing the aesthetically pleasing and sleek appearance of the devices 100, 200, 300, 400, 500. Notably, the exemplary arrangements, despite being provided with the relatively large openings to the air inlets 123, 223, 323, 423 or 523, conceal the internal components or at least make them less conspicuous than might be the case with alternative arrangements (e.g., large forward-facing openings, louvers, inlet slits, grills, or the like) that lack such a turn or curving of the recessed portion 112, 212, 312, 412 or 512. By enabling removal of the cowling 120, 220, 320, 420 or 520, the illustrated embodiments may be provided in an easy-to-clean (as indicated above) configuration without compromising the aesthetically pleasing appearance of the device 100, 200, 300, 400, 500 and without sacrificing concealment of the internal components.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. In view of this disclosure, those skilled in the art will appreciate that various adaptations and modifications of the just described embodiments may be configured without departing from the scope and spirit of the invention. Therefore, it is to be understood that, within the scope of the appended claims, the invention may be practiced other than as specifically described herein.

What is claimed is:

1. A housing for an air treatment device comprising:

a front portion;

a rear portion comprising first and second opposed exterior side surfaces respectively extending rearward from said front portion, an air inlet located on said front portion; and an air outlet located on said first exterior side surface of said rear portion, wherein said first exterior side surface of said rear portion comprises a first curvature adjacent said front portion, wherein said first curvature is concave to thereby direct air flow from said air outlet away from said air inlet.

2. The housing of claim 1, wherein said first exterior side surface of said rear portion comprises a second curvature adjacent said first curvature, wherein said second curvature is convex.

3. The housing of claim 2, wherein said air outlet is located on said second curvature of said first exterior side surface.

4. The housing of claim 1, wherein said second exterior side surface of said rear portion comprises a third curvature adjacent said front portion, wherein said third curvature is concave.

5. The housing of claim 4, wherein said second exterior side surface of said rear portion comprises a fourth curvature that is convex and that is adjacent said third curvature.

6. The housing of claim 3, wherein said second exterior side surface of said rear portion comprises a third curvature adjacent said front portion, wherein said third curvature is concave and a fourth curvature that is convex and that is adjacent said third curvature.

7. The housing of claim 6, wherein said second curvature of said first exterior side surface of said rear portion and said fourth curvature of said second exterior side surface of said rear portion are adjacent to each other such that said rear portion forms a bell-shaped curve.

8. The housing of claim 1, wherein said first curvature of said first exterior side surface of said rear portion is generally symmetrical about a plane that extends through a middle of the housing and that is generally perpendicular to a bottom portion of the housing.

9. The housing of claim 1, further comprising a cowling releasably connected to said front portion of the housing, wherein said air inlet is configured to draw air around said cowling and into said air inlet.

10. The housing of claim 9, wherein said cowling comprises an exterior surface that is convex as viewed from an exterior of the housing.

11. The housing of claim 1, further comprising a cavity in one of said front portion or said rear portion configured for receipt of a remote control device.

12. The housing of claim 1, wherein said front portion comprises an exterior surface, wherein at least a portion of said exterior surface has a convex curvature.

13. The housing of claim 12, wherein said convex curvature exhibits a higher rate of curvature toward a top section of said front portion than a rate of curvature exhibited by a lower section of said front portion.

14. The housing of claim 1, wherein at least one of said front portion or said rear portion comprises a slot for storing at least a portion of a power cord associated with the device.

15. The housing of claim 1, wherein said rear portion comprises a slot extending from said first exterior side surface towards said second exterior side surface, said slot being structured to store at least a portion of a power cord associated with the device.

16. The housing of claim 1, wherein at least one of said front portion or said rear portion comprises a knob for supporting at least a portion of a power cord associated with the device.

17. The housing of claim 1, wherein said rear portion comprises a recessed portion, said recessed portion comprises at least one knob structured to support at least a portion of a power cord associated with the device.

18. A housing for an air treatment device comprising:

a front portion;

a rear portion comprising first and second opposed exterior side surfaces respectively extending rearward from said front portion;

an air inlet located on said front portion; and an air outlet located on said first exterior side surface of said rear portion, wherein said first and second exterior side surfaces of said rear portion comprise respective concave curves adjacent to said front portion and convex curves respectively adjacent the concave curves.

19. The housing of claim 18, wherein said convex curves of said first and second exterior side surfaces of said rear portion are adjacent to each other such that said first and second exterior side surfaces of said rear portion form a generally bell-shaped curve.

20. The housing of claim 18, further comprising a cowling releasably connected to said front portion of the housing, wherein said air inlet is configured to draw air around said cowling and into said air inlet.

21. The housing of claim 20, wherein said cowling comprises an exterior surface that is convex as viewed from an exterior of the housing.

22. The housing of claim 18, further comprising a cavity in one of said front portion or said rear portion configured for receipt of a remote control device.

23. The housing of claim 18, wherein said front portion comprises an exterior surface, wherein at least a portion of said exterior surface has a convex curvature.

24. The housing of claim 23, wherein said convex curvature exhibits a higher rate of curvature toward a top of said front portion than a rate of curvature exhibited by a lower section of said front portion.

25. The housing of claim 18, wherein at least one of said front portion or said rear portion comprises a slot for storing at least a portion of a power cord associated with the device.

26. The housing of claim 18, wherein at least one of said front portion or said rear portion comprises a knob for supporting at least a portion of power cord associated with the device.

27. A housing for an air treatment device comprising:

an air inlet;

an air outlet;

a rear portion;

a front portion comprising a first curvature extending from a first point on said front portion and continuing upwardly and rearward toward said rear portion to a second point positioned near a top perimeter of said front portion; and a control display positioned on said front portion, wherein at least a portion of said control display comprises a display curvature that generally conforms to said first curvature of said front portion.

28. The housing of claim 27, wherein the first curvature of said front portion is generally convex as viewed from an exterior of the housing and is generally symmetrical about a plane that runs through a middle of the housing and that is generally perpendicular to a bottom portion of the housing.

29. The housing of claim 27, wherein said front portion further comprises a second curvature positioned below said first curvature, wherein said second curvature is generally convex as viewed from an exterior of the housing and exhibits a smaller rate of curvature than the first curvature.

30. The housing claim 29, further comprising a cowling releasably connected to the housing, wherein said air inlet is configured to draw air around said cowling and into said air inlet, and wherein said cowling is at least partially positioned in said second curvature.

31. The housing of claim 30, wherein said cowling includes a cowling curvature that is convex as viewed from an exterior of the housing.

32. The housing of claim 27, wherein at least one of said front portion or said rear portion comprises a slot for storing at least a portion of a power cord associated with the device.

33. The housing of claim 27, wherein at least one of said front portion or said rear portion comprises a knob for supporting at least a portion of power cord associated with the device.

34. A housing for an air treatment device comprising:

a recessed portion comprising upper, lower, and opposed side edges;

a cowling releasably connected to the housing and positioned relative to said recessed portion, wherein said cowling abuts one of said edges of said recessed portion and is spaced apart from the other said edges of said recessed portion to thereby define a generally U-shaped opening between said cowling and the other said edges of said recessed portion for air to enter the air treatment device; and a rear portion of the housing comprising a flared outer surface adapted to deflect air from an outlet of the housing in a direction laterally away from said generally U-shaped opening.

35. The housing of claim 34, wherein said recessed portion of the housing is located in a front portion of the housing, and wherein said cowling is located on said front portion.

36. The housing of claim 35, wherein said front portion comprises a first curvature positioned at least partially above said cowling and extending from a first point on said front portion upwardly and backwardly to a second point on said front portion.

37. The housing of claim 36, further comprising a control display positioned on said front portion, wherein at least a portion of said control display comprises a display curvature that generally conforms to said first curvature of said front portion.

38. The housing of claim 36, wherein said cowling comprises a cowling curvature extending from a first point on said cowling upwardly and backwardly to a second point on said cowling, and wherein said cowling curvature relatively smoothly transitions into said first curvature.

39. The housing of claim 38, wherein said cowling curvature is concave when viewed from an exterior of the housing and diverges rearward as said cowling curvature extends laterally away from a central region of said cowling.

40. The housing of claim 34, wherein said rear portion comprises a slot for storing at least a portion of a power cord associated with the device.

41. The housing of claim 34, wherein said rear portion comprises a knob for supporting at least a portion of power cord associated with the device.

42. A housing for an air treatment device comprising:

a recessed portion comprising upper, lower, and opposed side edges;

a cowling releasably connected to the housing and positioned relative to said recessed portion, wherein said cowling is spaced apart from a plurality of said edges to define at least part of an air inlet between said cowling and said plurality of said edges;

a rear portion of the housing comprising a flared outer surface adapted to deflect air from an outlet of the housing in a direction laterally away from said recessed portion; and at least one filter offset feature inside the housing and adapted to maintain an offset between filters that are arranged to pass air in substantially the same direction so that front-facing surfaces of said filters are not coplanar when fully inserted into the housing.

43. The housing of claim 42, wherein said rear portion comprises a slot for storing at least a portion of a power cord associated with the device.

44. The housing of claim 42, wherein said rear portion comprises at least one knob for supporting at least a portion of a power cord associated with the device.

* * * * *